US006354852B2

(12) United States Patent
Noro et al.

(10) Patent No.: US 6,354,852 B2
(45) Date of Patent: Mar. 12, 2002

(54) LEVER-TYPE CONNECTOR

(75) Inventors: Yutaka Noro; Yutaka Kobayashi, both of Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 09/851,833

(22) Filed: May 9, 2001

(30) Foreign Application Priority Data

May 23, 2000 (JP) ..... 12-151257

(51) Int. Cl.[7] ..... H01R 13/62
(52) U.S. Cl. ..... 439/157
(58) Field of Search ..... 439/157, 152, 439/153, 154, 155, 156, 158, 159, 372

(56) References Cited

U.S. PATENT DOCUMENTS

| | | | | |
|---|---|---|---|---|
| 5,445,530 A | | 8/1995 | Inoue et al. | |
| 5,609,494 A | * | 3/1997 | Yamaguchi et al. | 439/157 |
| 5,681,175 A | | 10/1997 | Busse et al. | |
| 5,820,409 A | * | 10/1998 | Clark et al. | 439/595 |
| 5,938,458 A | | 8/1999 | Krehbiel et al. | |
| 6,120,308 A | | 9/2000 | Hayashi | |

FOREIGN PATENT DOCUMENTS

| | | |
|---|---|---|
| JP | 3-4672 | 3/1991 |

* cited by examiner

*Primary Examiner*—Neil Abrams
*Assistant Examiner*—Chandrika Prasad
(74) *Attorney, Agent, or Firm*—Anthony J. Casella; Gerald E. Hespos

(57) ABSTRACT

A lever-installed cover (50) is inserted into a lever accommodation space (404) disposed between a wall (41) of a female housing (21) and an accommodation wall (42). A reinforcing wall (43) connects a front end of the wall (41) and that of the accommodation wall (42) to each other. An opening (45) through which a follower pin (17) of a male connector (10) can pass is formed on the reinforcing wall (43). The opening (45) matches an entrance of a cam groove (74) of the lever (70) when the lever (70) is located at an initial position. Both connectors (10) and (20) are fitted on each other and removed from each other by rotating the lever (70), with the cam groove (74) of the lever (70) engaging the follower pin (17). The lever (70) can be rotated back to the initial position to separate the connectors (10) and (20) from each other. The follower pin (17) slides on the guide portion (81) formed at the rear edge of the open portion (45). Thus, the follower pin (17) can be guided smoothly to the open portion (45).

12 Claims, 21 Drawing Sheets

LEVER-TYPE CONNECTOR

BACKGROUND OF THE INVENTION

1. Field of the Invention

The present invention relates to a lever-type connector.

2. Description of the Related Art

A lever-type connector is disclosed in Japanese Utility Model Application Laid-Open No. 3-4672. This lever-type connector, has a female housing configured to be fitted on a male housing. The female housing includes opposite front and rear ends and upper and lower surfaces that extend between the front and rear ends. Upper and lower protection walls extend forward from the rear end of the female housing in spaced relationship from the respective upper and lower surfaces, and a gate-shaped lever is installed on the inner side of each protection wall. Thus the protection walls protect the lever. Shaft holes are formed on the protection walls, and shaft pins extend through the shaft holes to support the lever rotatably. The male housing includes a hood that can penetrate into the space between the outer surface of the female housing and the inner surface of the protection walls.

The housings are mated to each other by first rotating the lever to a state in which a follower pin on the outer surface of the male housing has penetrated into a circular arc-shaped cam groove formed on the lever. The lever then is rotated, and the housings approach each other due to the cam action between the follower pin and the cam groove.

The front portion of the lever, in this construction, may have an inward warp that may interfere with the male housing. A correction wall formed on the inner side of the lever could solve this problem. However, it would be difficult to install such a lever on the female housing. To overcome these problems, the present applicant proposed a construction disclosed in Japanese Patent Application Laid-Open No. 142966. In this construction, the lever is installed on an installation member and then the installation member then is installed on the female housing.

In this construction, the protection wall on the outer side of the lever should prevent deformation of the lever in response to a force on the lever in a direction in which the lever is opened outward while the operation of rotating the lever is being performed. However, the protection wall may not have a sufficient thickness due to a demand for miniaturization of the connector. Thus, the lever may deform outward, and may cause a deformation of the protection wall during the operation.

To prevent the lever from being opened, it is conceivable to increase the strength of the protection wall by providing a reinforcing wall between the front end of the protection wall and the front end of the correction wall. In this case, an open portion is formed by partly cutting out the reinforcing wall so that the follower pin of the male housing can pass therethrough. To protect the lever, the open portion has a minimum size necessary for the follower pin.

However, there is a problem in separating both housings from each other. More particularly, the housings are separated from each other after rotating the lever to the initial position in which the cam groove and the open portion match each other. At this time, if the cam groove has a large degree of play relative to the follower pin because of a variation in size tolerance generated in a molding operation, both housings are liable to be loose in separating them from each other. As a result, when the follower pin moves from the cam groove to the open portion, there is a possibility that the follower pin is caught by an edge at the rear side of the open portion. Thus, the operation of separating both housings from each other cannot be performed smoothly.

SUMMARY OF THE INVENTION

The present invention has been made in view of the above-described situation. Accordingly, it is an object of the present invention to easily perform an operation of removing both housings from each other.

The subject invention is directed to a lever-type connector having a first connector housing and a second connector housing capable of fitting on the first connector housing. The first connector housing includes a lever having a cam groove that engages a follower pin formed on the second connector housing. The lever is rotated to an initial position in which the entrance to the cam groove is at the front of the first connector housing. The first and second connector housings then are moved toward one another sufficiently for the follower pin and the cam groove to have engaged each other. The lever then can be rotated to fit the first connector housing and the second connector housing on each other. The lever subsequently can be rotated in the opposite direction to separate the first connector housing and the second connector housing from each other.

A protection wall is formed on an outer side of the lever and is connected, through a connection wall, with a front end of an outer surface of the first connector housing in a direction in which the first connector housing and the second connector housing are fitted on each other. An opening is formed on the connection wall and aligns with the entrance of the cam groove when the lever is placed at an initial position. Thus the opening in the connection wall permits the insertion and removal of the follower pin into the cam groove. A guide is formed on a rear edge of the opening such that when the follower pin moves from the cam groove to the opening, the follower pin is capable of sliding on a sliding surface of the guide inclining toward a peripheral surface of the opening.

According to the invention, both connector housings are fitted on each other by first the rotating the lever to the initial position, such that the entrance to the cam groove aligns with the opening in the connection wall. The first and second connector housings then are moved toward one another, such that the follower pin passes through the opening in the connection wall and engages the entrance to the cam groove. The lever then is rotated from the initial position, and the follower pin moves along the cam groove to bring both connector housings toward each other.

To move the connector housings away from each other, the lever is rotated in an opposite direction. When the follower pin reaches the entrance of the cam groove, and when the lever reaches the initial position at which the entrance of the cam groove matches the opening, both connector housings are separated from each other. If the cam groove has a play relative to the follower pin because of a variation in size tolerance generated in a molding operation, there is a possibility that both connector housings are loose in the separation operation. In this case, when the follower pin moves from the cam groove of the lever to the opening, the follower pin slides on the guide formed at the rear edge of the opening. Thus, the follower pin can be guided smoothly to the peripheral surface of the opening. Accordingly, the operation of removing both connectors from each other can be accomplished smoothly.

DETAILED DESCRIPTION OF THE PREFERRED EMBODIMENTS

Figure 1:
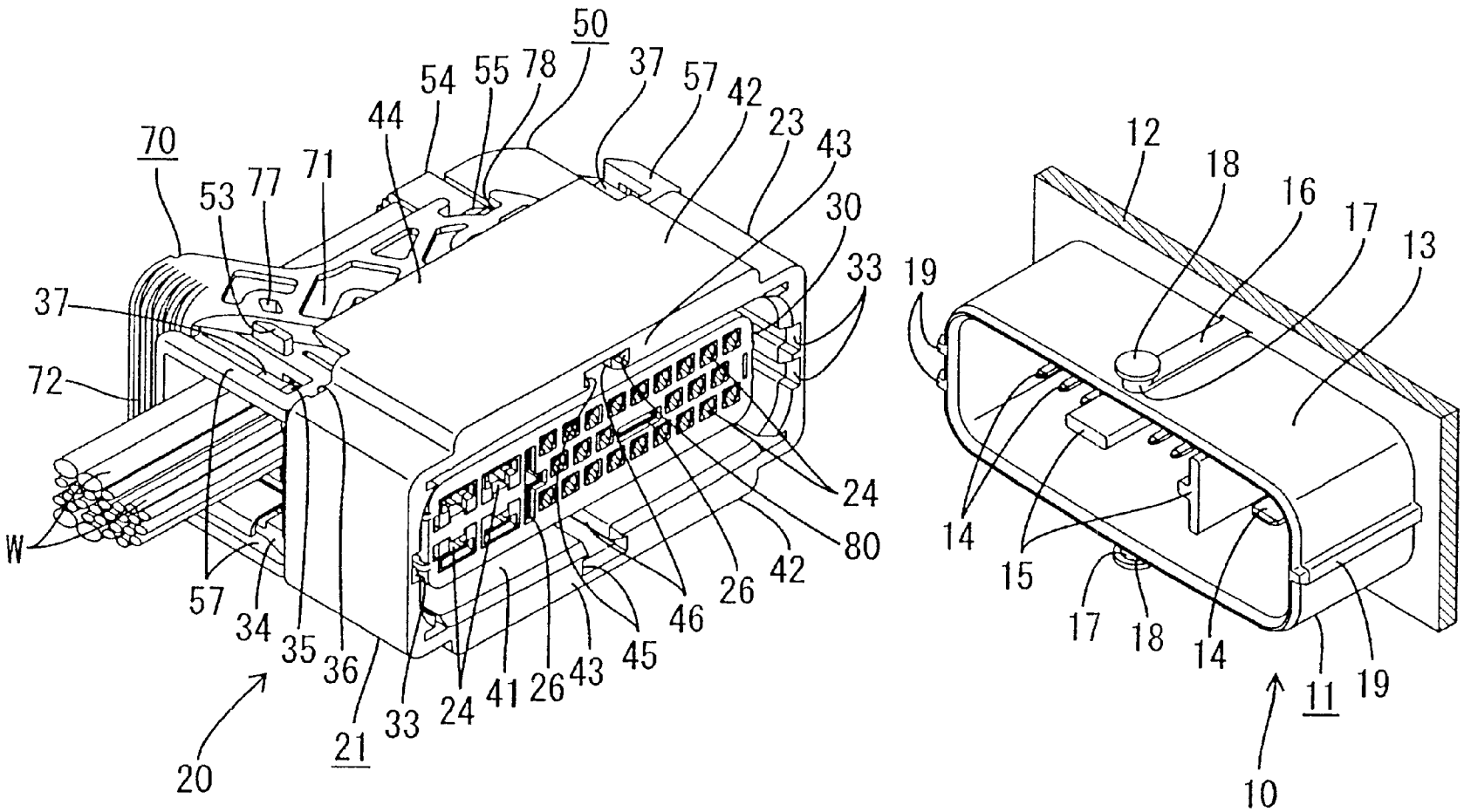
FIG. 1 is a perspective view showing male and female connectors according to an embodiment of the present invention.

A lever-type connector in accordance with the invention comprises a male connector 10 and a female connector 20 to be fitted on the male connector 10, as shown in FIG. 1. A lever 70 is installed on the female connector 20. In the description below, fit-in sides of the male connector 10 and the female connector 20 are referred to as the front or forward sides.

Figure 2:
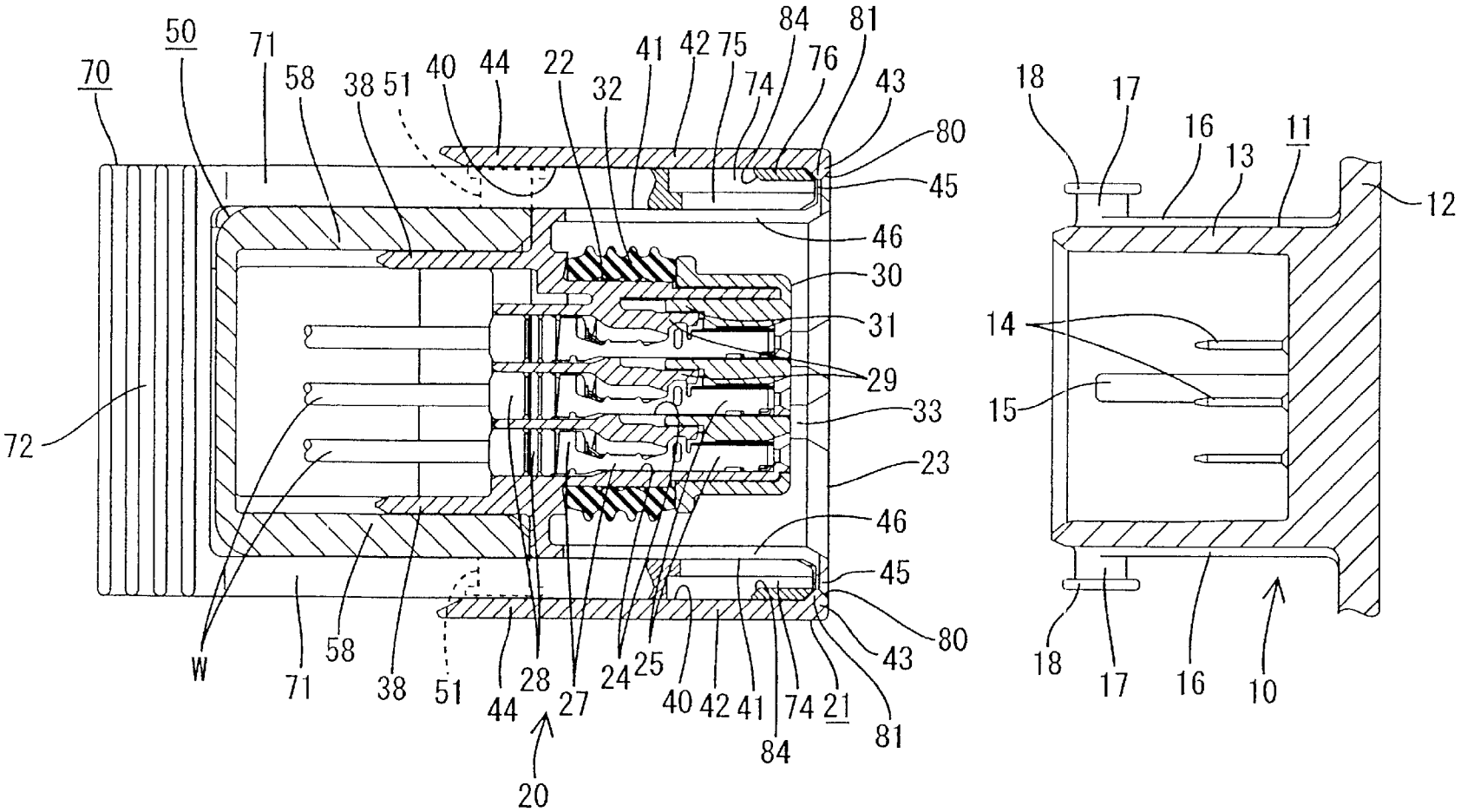
FIG. 2 is a sectional side view showing both connectors shown in FIG. 1.
Figure 3:
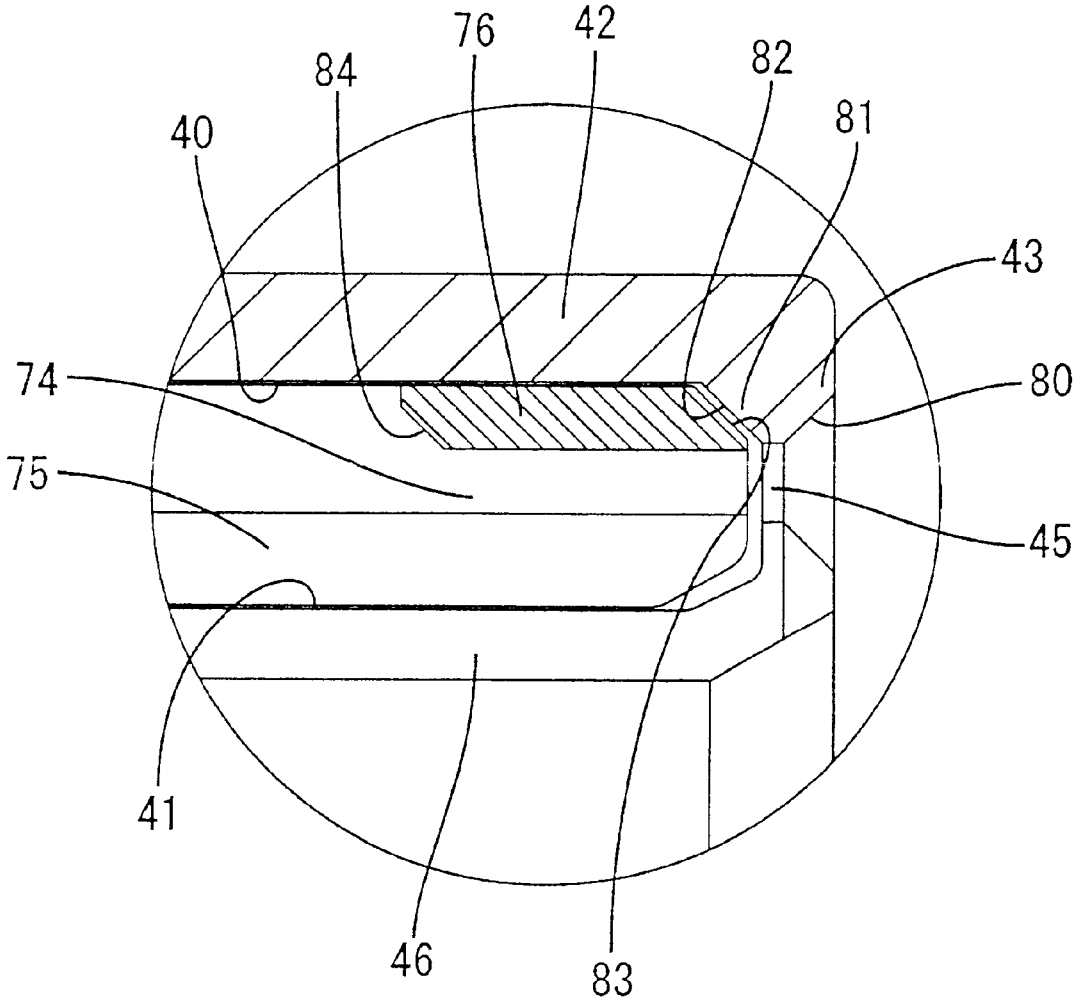
FIG. 3 is an enlarged view showing the neighborhood of a guide portion in FIG. 2.
Figure 4:
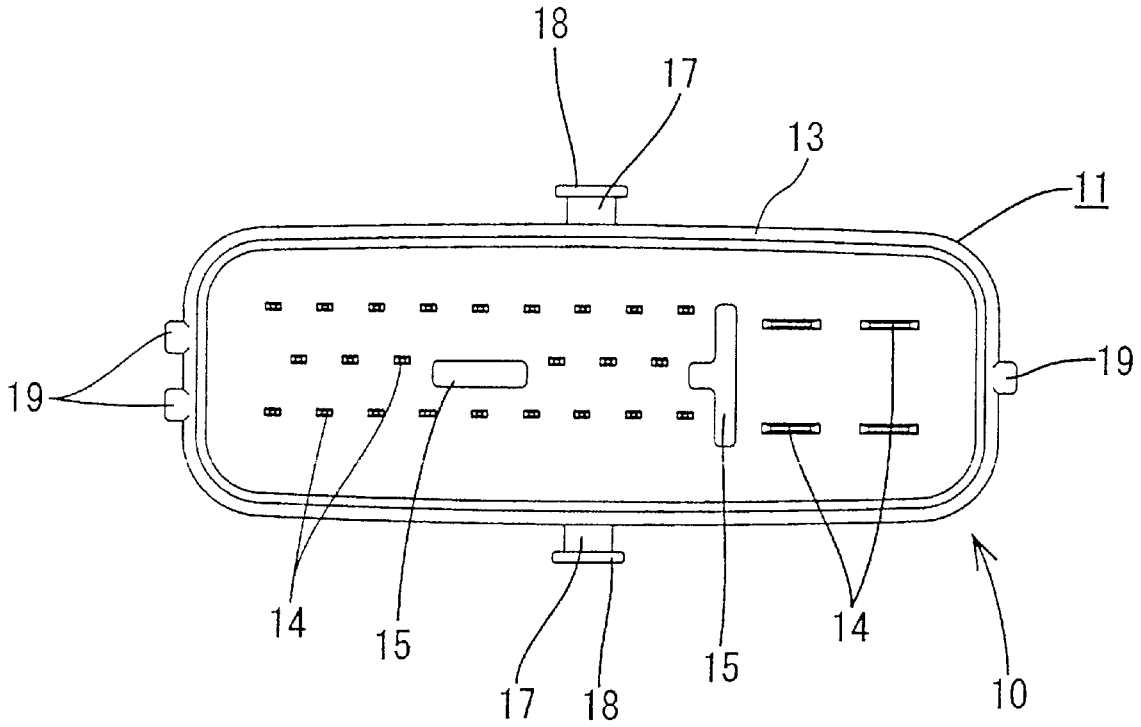
FIG. 4 is a front view showing a male connector.

As shown in FIGS. 1 and 2, the male connector 10 has a male housing 11 that projects forward from a wall 12 of an electric appliance. A cylindrical hood 13 is formed on the male housing 11 and projects forward. As shown in FIGS. 2 and 4, a plurality of tab-shaped larger and smaller male terminal fittings 14 are provided to project forward from the rear end surface of the male housing 11. More specifically, two larger male terminal fittings 14 are provided on each of upper and lower stages located on the right side of FIG. 4, and eight smaller male terminal fittings 14 are provided on each of three stages located on the left side of FIG. 3. Two differently shaped guide ribs 15 are provided in the male housing 11 such that one is located between the larger and smaller male terminal fittings 14 and the other is located at the center of the smaller male terminal fittings 14. As shown in FIG. 1, a thin guide rail 16 is provided at the longitudinal center of the outer surfaces of each of the upper and lower walls of the hood 13 of the male housing 11 such that the guide rails 16 extend from the front end of the hood 13 to the rear end thereof. A cylindrical upper follower pin 17 projects upward from the front end of the upper guide rail 16, and a cylindrical lower follower pin 17 projects downward from the front end of the lower guide rail 16. The follower pins 17 are capable of penetrating into cam grooves 74 formed on the lever 70 to be installed on the female housing 21 of the female connector 20, as described later. A disk-shaped flange 18 is formed on the end of each follower pin 17 such that the diameter of the upper follower pin 17 becomes larger toward its upper end, whereas the diameter of the lower follower pin 17 becomes larger toward its lower end. Referring to FIG. 1, one guide projection 19 is formed on the hood 13 at its right side surface, and two guide projections 19 are formed on the hood 13 at its left side surface. Thus, the male housing 11 is not symmetrical with respect to the center in its longitudinal direction.

Figure 5:
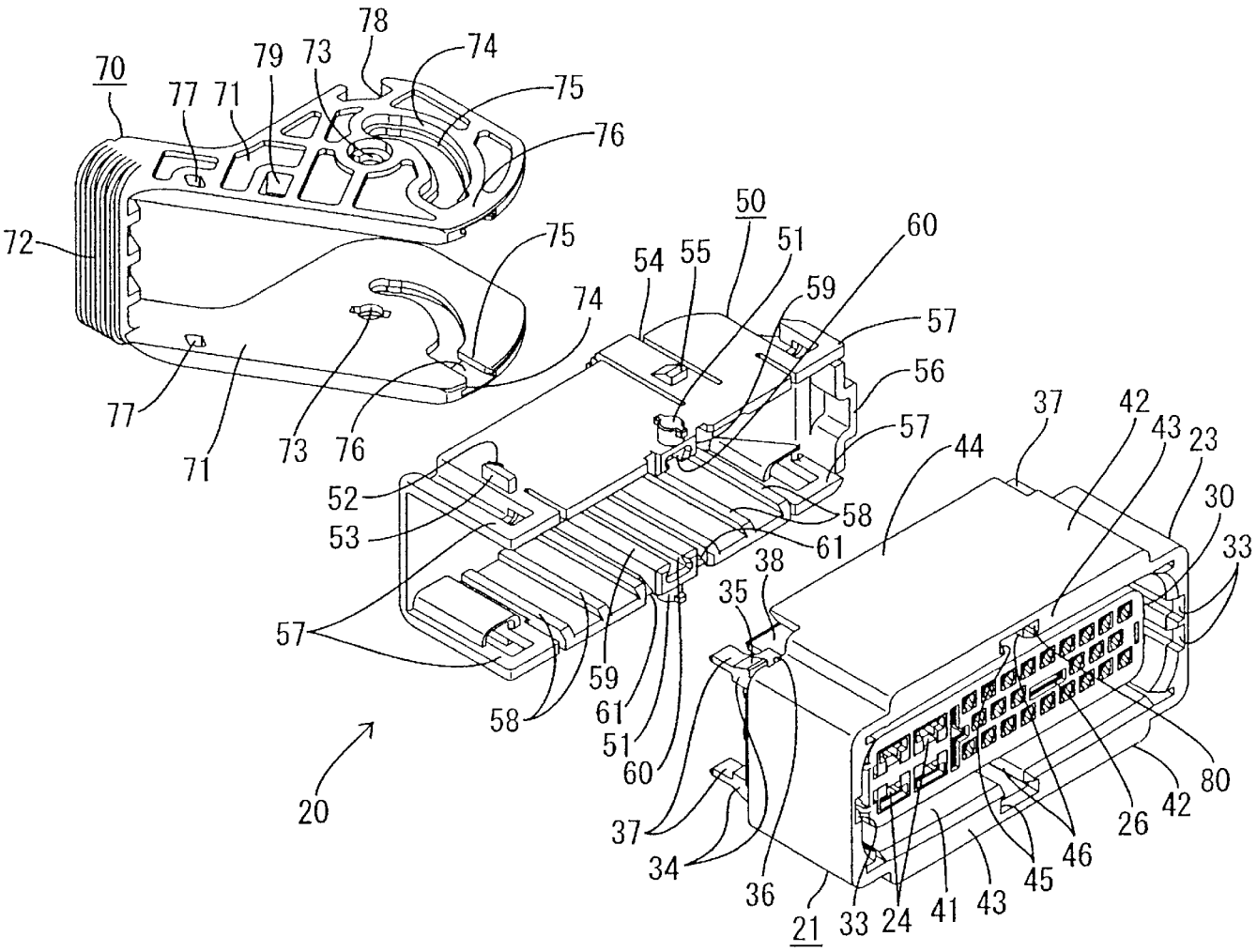
FIG. 5 is a perspective view showing the female housing, a cover, and lever.

As shown in FIG. 5, the female connector 20 has a female housing 21, a cover 50 to be installed on the rear side of the female housing 21, and the lever 70 to be installed on the cover 50.

As shown in FIG. 2, the female housing 21 has a terminal accommodation portion 22 that accommodates female terminal fittings 25 and a cylindrical female-side hood 23 that surrounds the terminal accommodation portion 22. The hood 13 of the male housing 11 is capable of penetrating into the space between the terminal accommodation portion 22 and the female-side hood 23.

Figure 6:
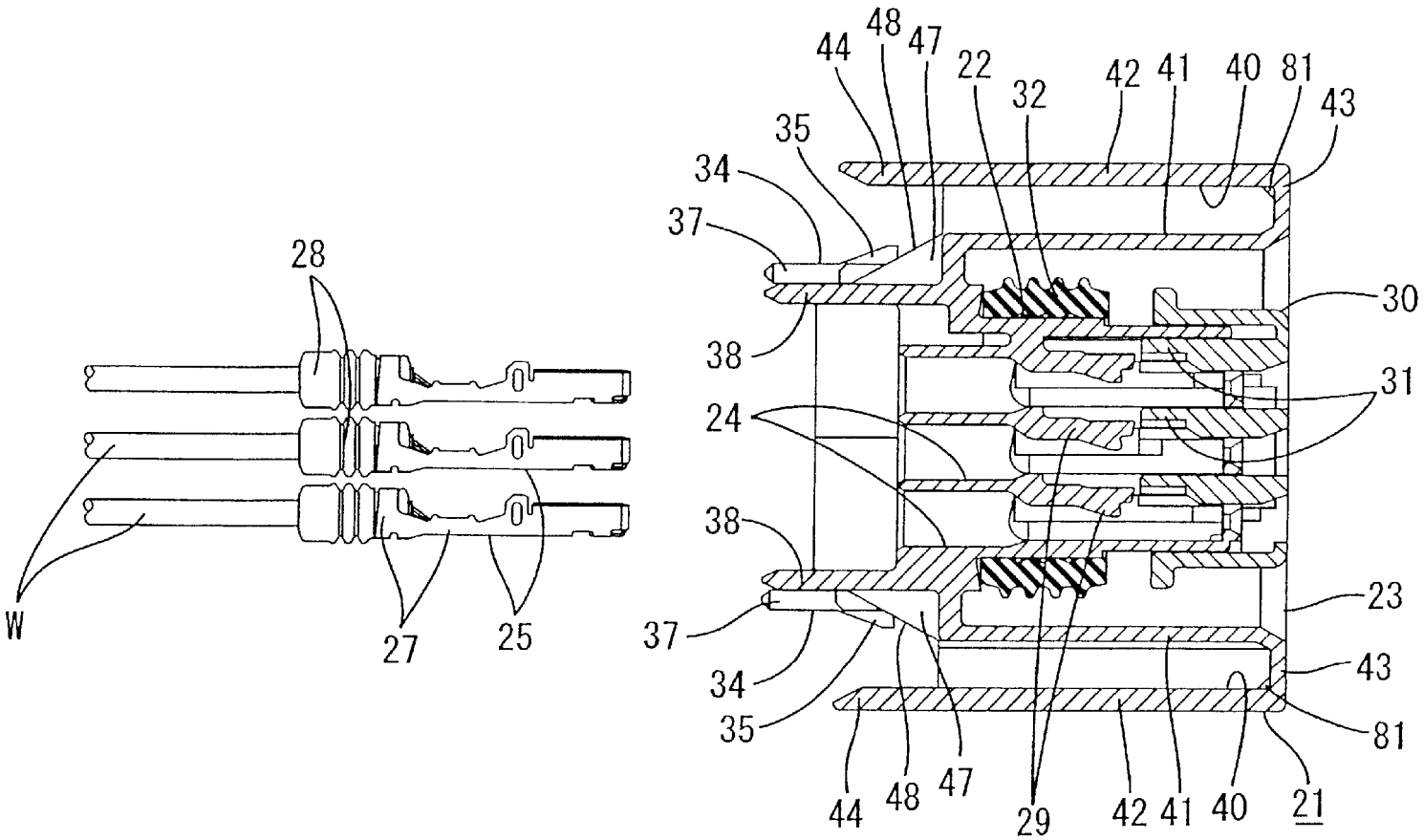
FIG. 6 is a sectional side view showing the female housing and a female terminal fitting.

As shown in FIG. 6, cavities 24 are provided in the terminal accommodation portion 22 at positions corresponding to the male terminal fittings 14 of the male connector 10. Female terminal fittings 25 are connected to ends of electric wires W and can be inserted into the respective cavities 24 from the rear side of the female housing 21. As shown in FIG. 5, larger and smaller female terminal fittings 25 can be inserted into the cavities 24. More specifically, two larger cavities 24 are provided on each of upper and lower stages located on the left side of FIG. 4, and 24 smaller male terminal fittings 14 are provided on three stages located on the right side of FIG. 4. Guide holes 26 are formed at two positions of the front end surface of the terminal accommodation portion 22. The guide holes 26 are dimensioned and located to accommodate the guide ribs 15 of the male connector 10.

As shown in FIG. 6, the female terminal fitting 25 is box-shaped at its front and has a barrel portion 27 at its rear. The barrel portion 27 is crimped to the electric wire W and a rubber plug 28 is mounted at the terminal thereof. The rubber plug 28 is in close contact with inner surface of the rear portion of the cavity 24 to waterproof the inside of the cavity 24. A flexible resin lance 29 is accommodated in the smaller cavity 24 at its lower side, and is locked to the rear end of the front portion of the female terminal fitting 25. A forwardly open flexible space S is formed below the lance and allows an elastic deformation of the lance 29. In the larger cavities 24, the lances 29 face in opposite directions. The flexible space S for the upper and lower larger cavities 24 is in the region between the oppositely facing lances 29.

Figure 7:
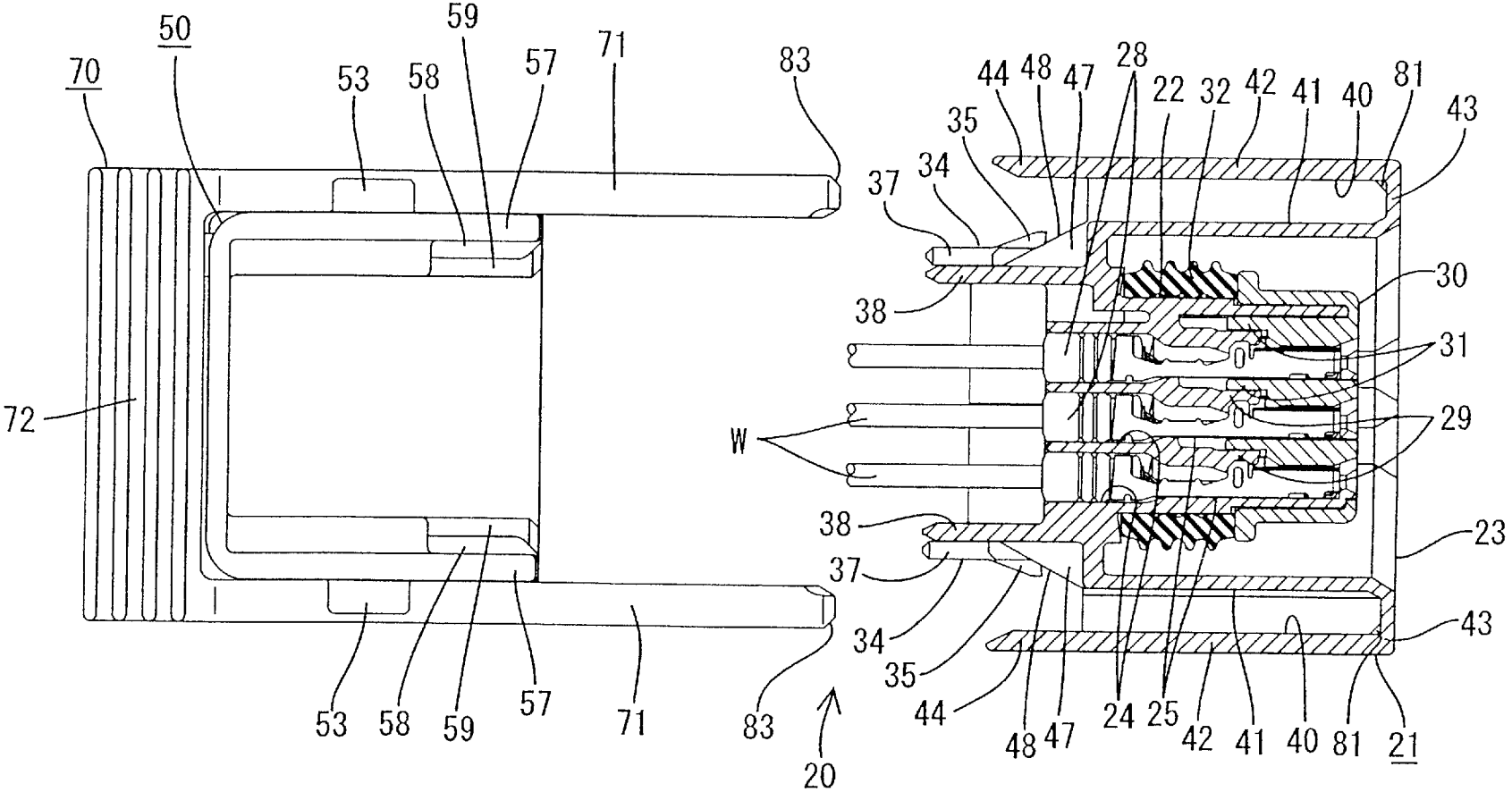
FIG. 7 is a partly cutout side view showing the female housing accommodating the female terminal fitting and the lever-installed cover.

A front retainer 30 can be installed on the peripheral surface of the front side of the terminal accommodation portion 22 of the female housing 21. The front retainer has a flexure prevention portion 31 that is capable of entering each flexible space S. The front retainer 30 is installed at a temporary locking position before the female terminal fittings 25 are inserted into the respective cavities 24. In this temporary lock position, the flexure prevention portion 31 is outside the flexure space S, and flexible deformation of the lance 29 is permitted. As shown in FIG. 7, the front retainer 30 is moved to a main lock position after the female terminal fitting 25 is inserted into the cavity 24. Thus, the flexure prevention portion 31 enters the flexure space S, and flexure of the lance 29 is prevented. The front retainer 30 is held at the temporary locking position and the main locking position by an unshown holding construction.

A seal ring 32 can be installed on the terminal accommodation portion 22 and in close contact with the peripheral surface of the rear side of the front retainer 30. The inner peripheral surface of the hood 13 is fitted on the outer side of the terminal accommodation portion 22 and is brought into close contact with the peripheral surface of the seal ring 32. Four lips projecting from each of the inner and outer peripheral surfaces of the seal ring 32.

The female-side hood 23 projects outward and forward from the peripheral surface of the rear side of the terminal accommodation portion 22. An installing construction is provided on the rear end of the female side hood 23 for installing the cover 50 (described later) on the female housing 21. As shown in FIG. 5, the upper and lower walls of the female-side hood 23 are formed stepwise and open rearward like a bag. The female-side hood 23 has a lever accommodation space 40 for accommodating the lever 70. Guide grooves 33 are formed rearward in a predetermined length from the front end of the inner surface of the female-side hood 23 at positions corresponding to the positions of the respective guide projections 19. Thus the guide projections 19 of the male housing 11 can enter the guide grooves 33.

Figure 8:
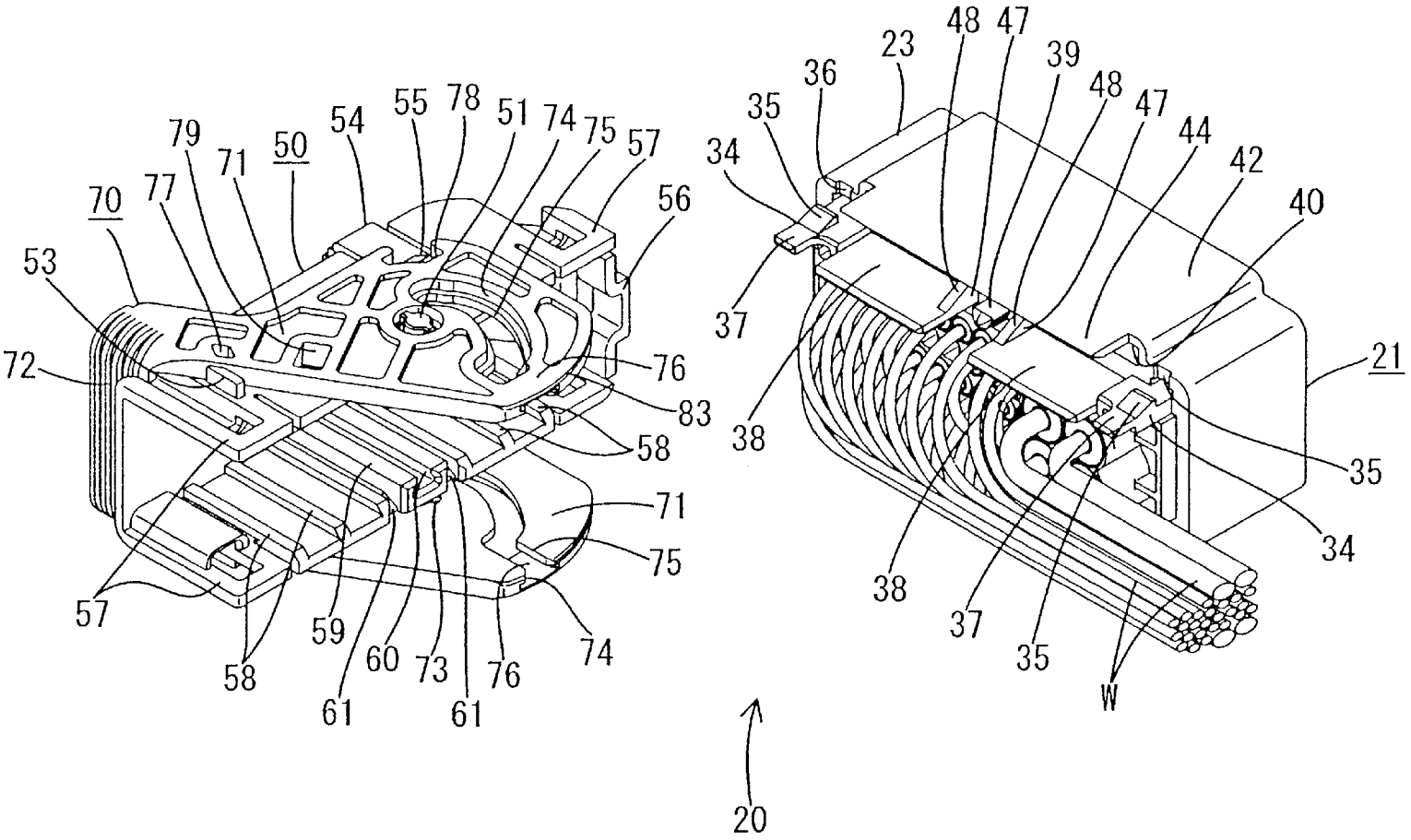
FIG. 8 is an exploded perspective view showing the female connector.

As shown in FIG. 5, the cover 50 is box-shaped, with its front side and a left side surfaces open. The cover 50 is installed on the female housing 21, with the open front side of the cover 50 covering the rear side of the female housing 21. As shown in FIG. 8, the electric wires W extend out from the cavities 24 of the female housing 21. The wires W then are bundled by bending about 90° to the right in FIG. 7 and taken out from the open left side surface of the cover 50 installed on the rear side of the female housing 21. The side surface of the cover 50 on the right side in FIG. 5 is formed obliquely to guide the electric wires W to the left side in FIG. 5. As shown in FIG. 5, vertical shafts 51 are formed on the outer surfaces of the upper and lower walls of the cover 50 for installing the lever 70 on the cover 50. Each shaft 51 is disposed at approximately the center in the longitudinal direction of the cover 50 and is positioned at the front end of the cover 50. The shaft 51 is cylindrical. However, two projections project in the front-to-back (widthwise) directions at the upper end of the upper shaft 51 and two projections project in the front-to-back (widthwise) direction at the lower end of the lower shaft projection 51.

As shown in FIG. 5, the lever 70 has an operation portion 72 that connects ends of a pair of legs 71 to each other. Thus the lever 70 is gate-shaped. The lever 70 is installed on the cover 50, with both legs 71 sandwiching the cover vertically. Shaft holes 73 penetrate through each leg 71, and the shaft projections 51 of the cover 50 can be fitted in the respective shaft holes 73. Thus, the lever 70 is rotatable on the shafts 51. The configuration of the shaft hole 73 is almost the same as that of the shaft projection 51. A circular hole is formed over the shaft hole 73 to prevent the projection of the shaft 51 from interfering with the portion over the shaft hole 73 when the lever 70 rotates. As shown in FIG. 8, the shaft 51 and the outer surface of the lever 70 are almost flush with each other when the lever 70 is installed on the cover 50. As shown in FIG. 5, a circular arc-shaped cam groove 74 is formed on each leg 71 and is dimensioned to receive one the follower pins 17 of the male housing 11. A receiving portion 75 is formed throughout the entire length of the cam groove 74 for receiving the flange 18 of the follower pin 17 at its inner side. An entrance of the cam groove 74 is continuous with a bridging portion 76 that confronts the receiving portion 75. Rotation of the lever 70 from the state in which the follower pin 17 has entered the cam groove 74, causes the follower pin 17 to move along the cam groove 74. Thus, an operation of fitting the male connector 10 and the female connector 20 on each other progresses (see FIG. 17).

The lever 70 is installed on the cover 50 by fitting the shaft projection 51 in the shaft hole 73 while both legs 71 are opened from the state shown in FIG. 5. Then, as shown in FIG. 8, the lever 70 is rotated at a predetermined angle to place the lever 70 at an initial position at which the entrance of the cam groove 74 faces the front. At the initial position, two first holding projections 52 formed on the outer surface of the upper and lower walls of the cover 50 are locked to two first holding holes 77 formed on the upper and lower legs 71, respectively. Thus, the lever 70 is unrotatably held unless a force is applied in excess of a predetermined amount. The side surface of each leg 71 on the left side in FIG. 4 is brought into contact with a stopper projection 53 on the side surface of each first holding projection 52, and the side surface of the operation portion 72 is bought into contact with the rear surface of the cover 50. In this manner, the lever 70 can be prevented from dislocating from the initial position. An elastically deformable cantilevered holding arm 54 projects rearward from the outer surface of the upper wall of the cover 50. A second holding projection 55 is formed on the upper surface of the holding arm 54. The second holding projection 55 can be locked to a cut-out 78 formed on the rear end surface of the cam groove 74 of the upper leg 71 of the lever 70. A stepped operation portion is formed at the free end of the holding arm 54. At this stage, the portion of each leg 71 forward from the shaft hole 73, namely, the portion that has the entrance of the cam groove 74 projects forward beyond the front end of the cover 50. At the initial position, both legs 71 can be prevented from slipping off from the cover 50 by placing the shaft 51 and the shaft hole 73 at an unmatching position.

Figure 19:
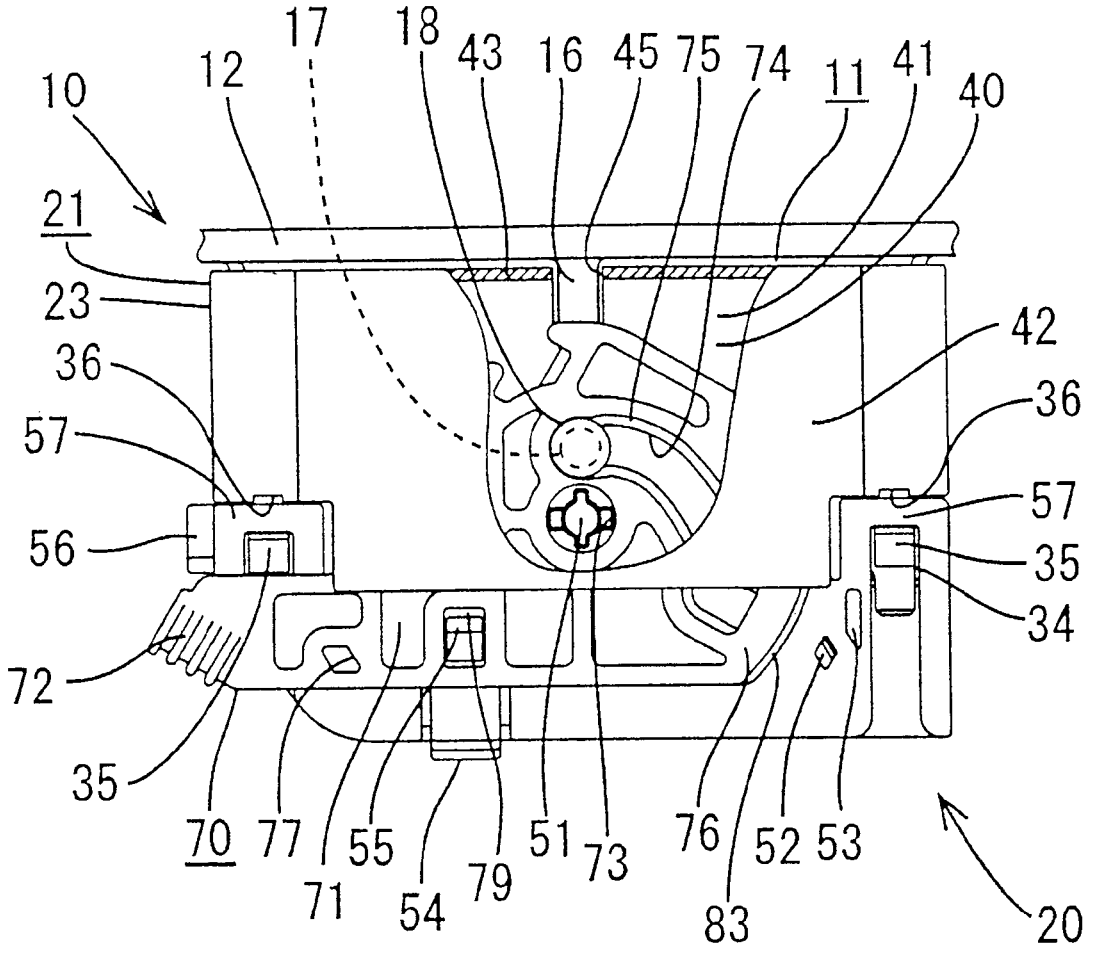
FIG. 19 is partly cutout plan view showing a state in which both connectors have been normally fitted on each other.

The lever 70 is rotated from the initial position to a completion position shown in FIG. 19. Referring to FIG. 5, at the completion position, the second holding projection 55 of the holding arm 54 is locked to a second holding hole 79 formed on the upper leg 71 to hold the lever 70 unrotatably in a reverse direction. At this time, the termination of the cam groove 74 is disposed immediately before the shaft projection 51, the shaft projection 51 is orthogonal to the shaft hole 73, the lever 70 does not project rearward beyond the rear end of the cover 50, and the side surface of the operation portion 72 is in contact with a stopper 56 formed on the side surface of the cover 50, on the right side in FIG. 4.

Figure 9:
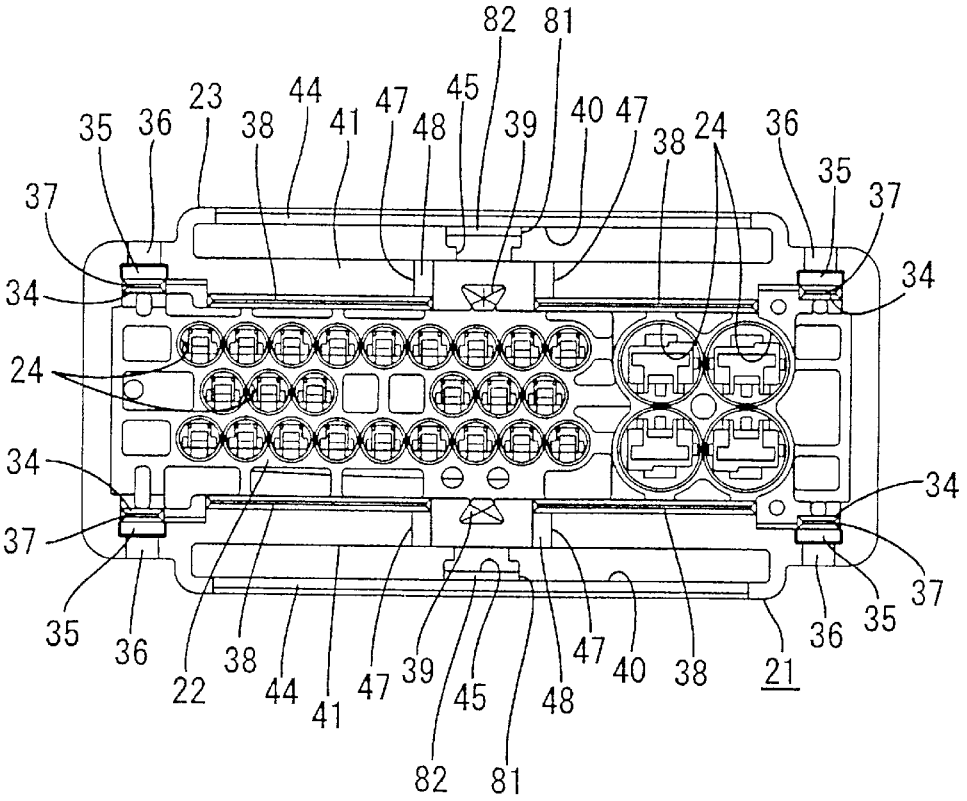
FIG. 9 is a rear view showing the female housing.
Figure 10:
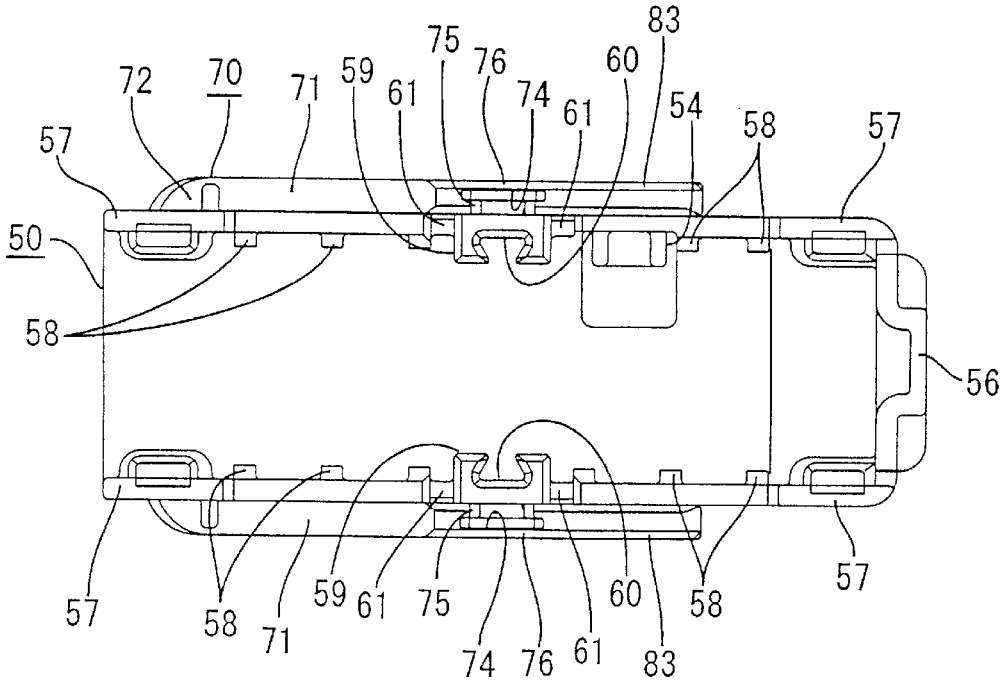
FIG. 10 is a front view showing the lever-installed cover.
Figure 11:
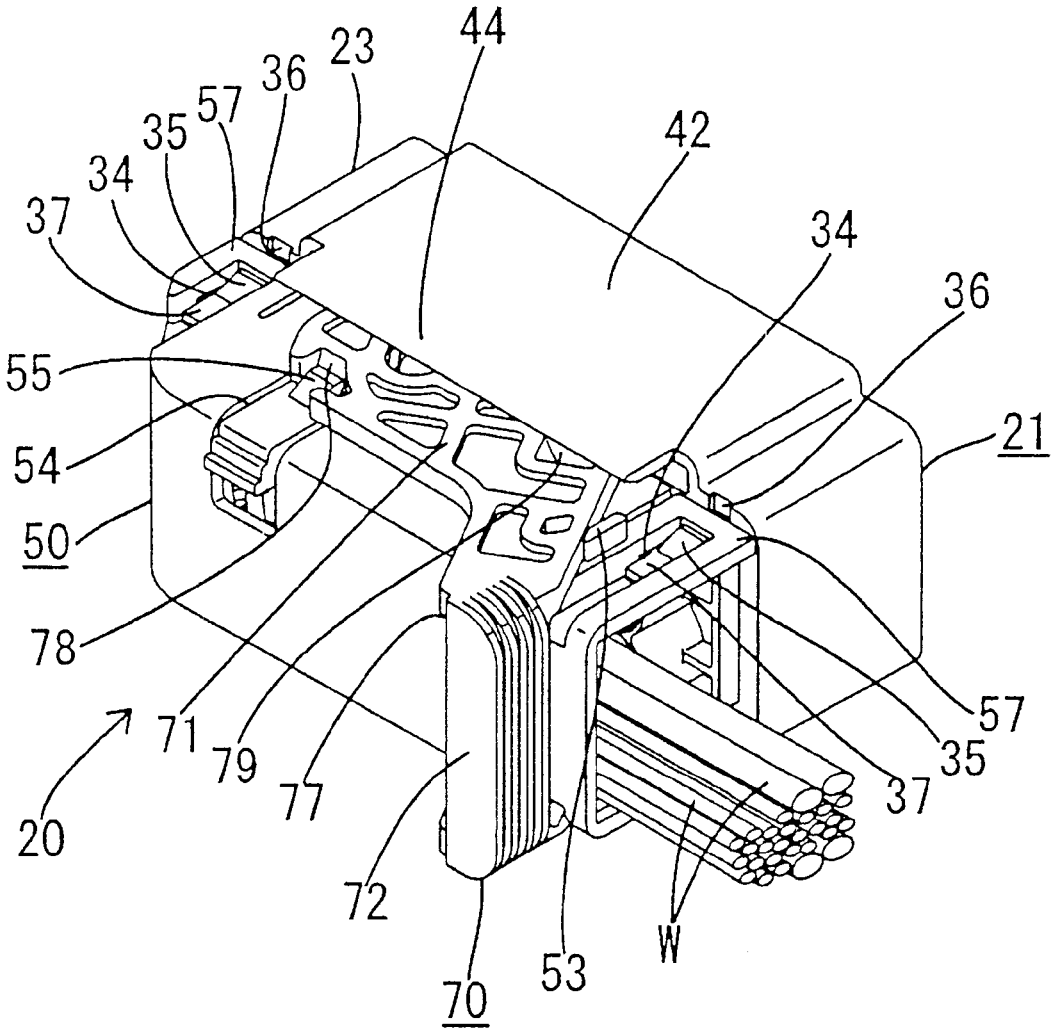
FIG. 11 is a perspective view showing the female connector.

As shown in FIGS. 8 and 9, cover-installing portions 34 project rearward from the four corners of the rear end surface of the female-side hood 23 of the female housing 21. A locking projection 35 is formed on the outer surface of each cover-installing portion 34. As shown in FIGS. 8 and 10, cantilevered locking pieces 57 project forwardly from the ends of the outer surface of upper and lower walls of the cover 50 in its longitudinal direction. The locking pieces 57 are locked to the locking projections 35 of each cover-installing portion 34 to keep the cover 50 installed on the female housing 21, as shown in FIG. 11. In the installed state, the front end surface of the cover 50 contacts the rear end surface of the female-side hood 23. The rear of each locking projection 35 is tapered to allow the locking piece 57 to ride over the locking projection 35 easily. A jig insertion groove 36 into which an unlocking jig can be inserted is formed on the rear end of the female-side hood 23 at a position that confronts the front surface of the locking projection 35.

As shown in FIGS. 8 and 9, a guide projection 37 projects rearward from the locking projection 35 on each cover-installing portion 34. Upper and lower flat guide plates 38 are spaced apart at a predetermined interval along a center part of the rear end surface of the female-side hood 23. As shown in FIG. 8, the rear end of the guide projection 37 and the rear end of the guide plate 38 are flush with each other in the longitudinal direction of the female housing 21. Thus, each guide projection 37 slides on the locking piece 57 during installation of the cover 50 on the female housing 21, and each guide plate 38 slides on each of a plurality of convexities 58 formed on the inner surfaces of the upper and lower walls of the cover 50. Therefore, the cover-installing operation can be facilitated. The inner surface of the guide projection 37 contacts the outer surface of an inwardly concave portion formed on the rear side of the locking piece 57 of the cover 50.

A positioning convexity 59 is formed at the center of the inner surface of the upper and lower walls of the cover 50, and inward from the convexities 58 located at the right and left of the cover 50, as shown in FIGS. 8 and 10. Therefore, the positioning convexity 59 is fitted between the right and left guide plates 38 of the female housing 21 and positions the cover 50 in its longitudinal direction during installation of the cover 50 on the female housing 21.

An engaging groove 60 is formed on each positioning convexity 59 throughout its entire length, as shown in FIGS. 8 and 10. The engaging groove 60 is open forward and inward, and the width of the engaging groove 60 becomes smaller toward its inward end. The engaging groove 60 is coincident with the shaft 51 in the widthwise direction of the cover 50. As shown in FIGS. 8 and 9, an engaging projection 39 projects rearward between the right and left guide plates 38 formed on the upper and lower rear end surfaces of the female-side hood 23 and can enter the engaging groove 60 in the positioning convexity 59 of the cover 50. The engaging projection 39 has a configuration that matches the periphery of the engaging groove 60. Thus, when the engaging projection 39 has entered the engaging groove 60, the side surface of the engaging projection 39 engages the periphery of the engaging groove 60. The engaging projection 39 is continuous with the outer surface of the rear end of the terminal accommodation portion 22 that projects rearward from the female-side hood 23.

Because the cover-installing construction is vertically symmetrical, the cover 50 can be installed on the female housing 21 when the cover 50 is turned upside down. Depending on a place on which the lever-type connector is installed, it is possible to change the direction in which the electric wire W is wired and the rotational direction of the lever 70.

Figure 14:
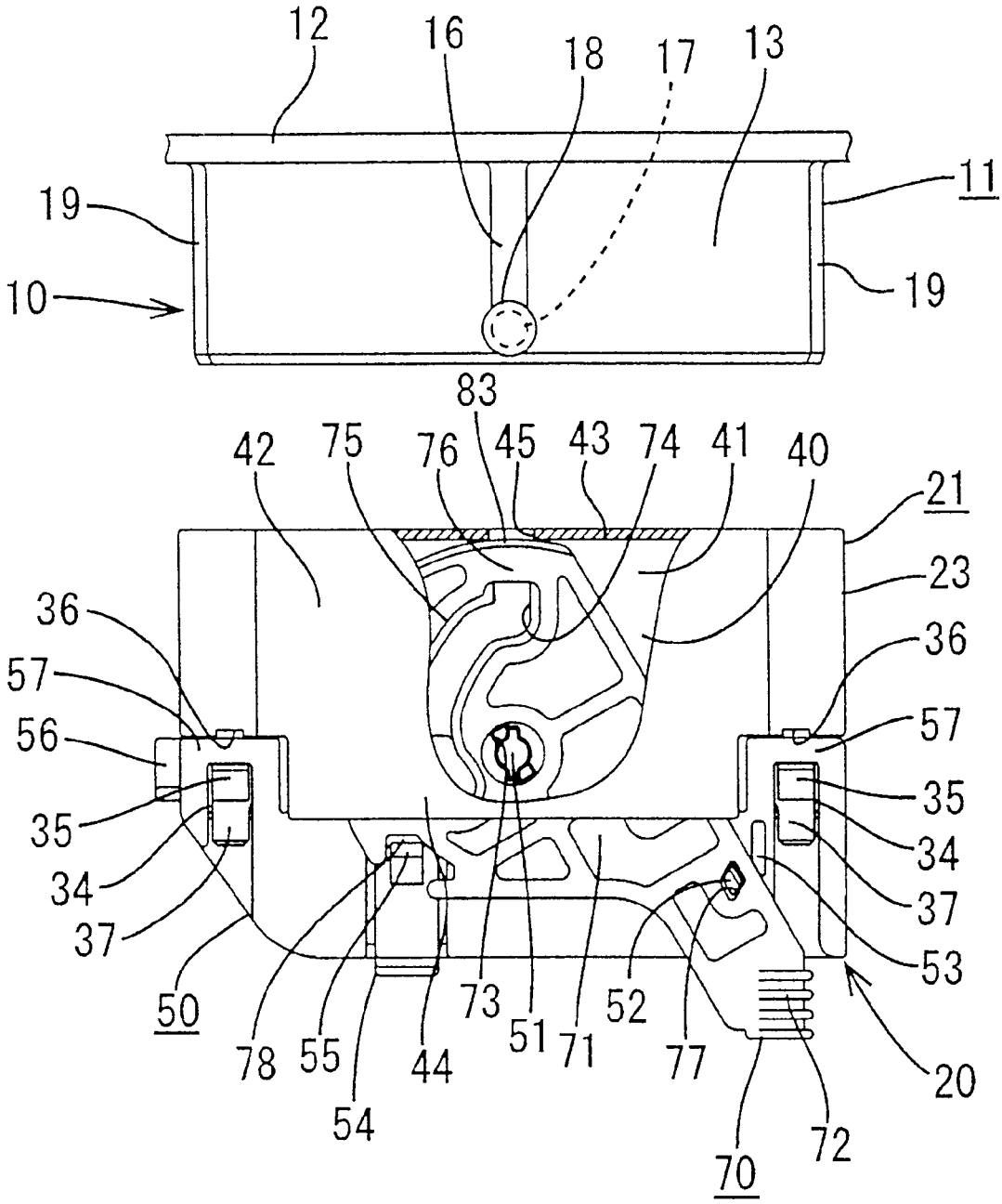
FIG. 14 is partly cutout plan view showing a state in which both connectors are fitted on each other.

As shown in FIGS. 7 and 8, the lever 70 is installed on the cover 50 by initially inserting the lever 70 into a lever accommodation space 40. More specifically, the lever accommodation space 40 is formed between a wall 41 and an accommodation wall 42 on the female-side hood 23. The lever accommodation space 40 is open to the rear. However, a reinforcing wall 43 joins the front end of the wall 41 and the front end of the accommodation wall 42 and closes the lever accommodation space 40 to the front. The interval between the wall 41 and the accommodation wall 42 is almost equal to the thickness of the legs 71 of the lever 70. Thus, as shown in FIGS. 2 and 14, the leg 71 of the lever 70 accommodated in each lever accommodation space 40 is held straight. Both ends of the accommodation wall 42 in its longitudinal direction are continuous with the wall 41, and the front end of the accommodation wall 42 is continuous with the wall 41 through the reinforcing wall 43. Thus, the accommodation wall 42 requires a high strength. When the lever 70 is in the lever accommodation space 40, the front of the leg 71 is disposed immediately rearward from the reinforcing wall 43, and a portion of the leg 71 that projects forward from the front end of the cover 50 is covered with the accommodation wall 42. At this time, the outer surface of the cover 50 and the inner peripheral surface of the lever accommodation space 40 of the wall 41 form a continuous plane.

An extended wall 44 projects rearward from the rear end of the accommodation wall 42. The extended wall 44 covers a shaft construction portion that consists of the shaft 51 of the cover 50 and the shaft hole 73 of the lever 70. That is, the accommodation wall 42 and the extended wall 44 cover the entire lever 70 placed at the initial position from the shaft construction portion to the front end of the lever 70 including the entrance of the cam groove 74. A tapered surface is formed on the inner surface of the rear end of the extended wall 44 for guiding the lever 70 into the lever accommodation space 40.

As shown in FIGS. 1 and 2, an opening 45 is formed on each of the reinforcing walls 43 to accommodate the follower pin 17 of the male housing 11 that is to be fit on the female housing 21. The wall 41 has a guide groove 46 that communicates with the opening 45. A part of the guide rail 16 at the root of the follower pin 17 penetrates into the guide groove 46.

The opening 45 is T-shaped in the front view of FIG. 9. Additionally, as shown in FIG. 2, the peripheral surface of the opening 45 almost matches the entrance of the cam groove 74 of the lever 70, which is immediately rearward from the reinforcing wall 43 when the lever is at the initial position. The reinforcing wall 43 is formed to extend a predetermined amount on the outer side of the opening 45 in the vertical direction. A bridging portion 76 of the lever 70 is disposed rearward from the reinforcing wall 43. That is, the open region of the opening 45 in the reinforcing wall 43 has a minimum size necessary for the follower pin 17 to pass therethrough so that the portion of the reinforcing wall 43 located on the outer side of the opening 45 protects the front end of the lever 70.

An introduction guide surface 80 is formed on an entire front edge of the opening 45, as shown in FIGS. 1 and 2. The introduction guide surface 80 forms an inclined plane continuous with the peripheral surface of the opening 45. Thus, the follower pin 17 slides on the introduction guide surface 80 during its entry into the opening 45 from the front. Accordingly, the introduction guide surface 80 guides the penetration of the follower pin 17 into the opening 45.

A guide 81 is formed on a rear edge of the opening 45 inside the lever accommodation space 40, as shown in FIGS.

Figure 16:
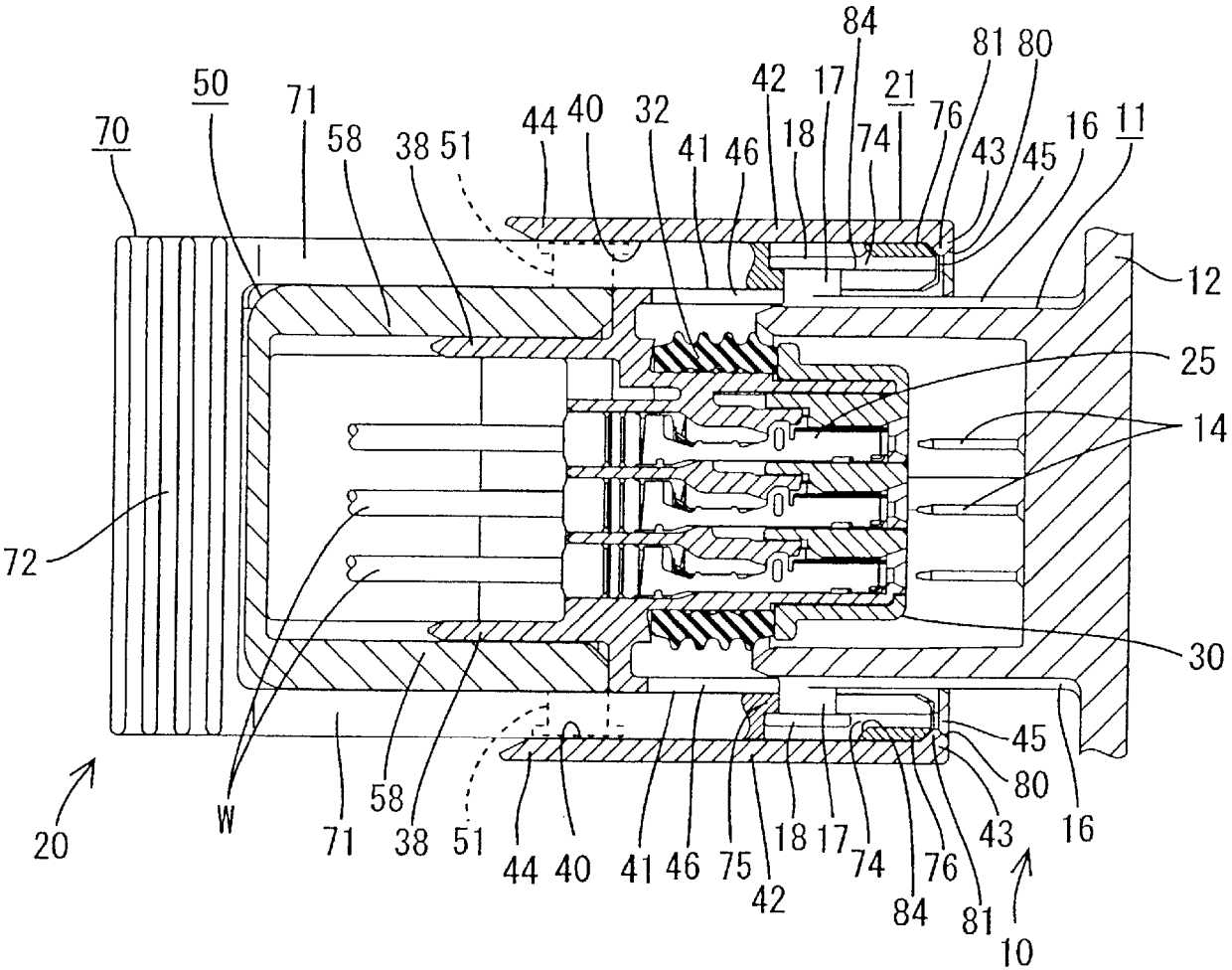
FIG. 16 is partly cutout side view showing the initial state in fitting both connectors on each other.

3 and 9. The guide 81 is disposed on the outer side of the edge of the opening 45 in the vertical direction. In other words, the guide 81 is disposed on the outer side of the flange 18 of the follower pin 17 that passes through the opening 45. As shown in FIG. 3, the bridging portion 76 of the lever 70 in the lever accommodation space 40 is immediately rearward from the guide 81 when the lever 70 is in the initial position. The region from the peripheral surface of the opening 45 to the inner surface of the accommodation wall 42 defines an inclined take-out guide plane 82 that is continuously formed on a surface that confronts the bridging portion 76 of the lever 70. As shown in FIG. 16, the flange 18 of the follower pin 17 may contact the take-out guide plane 82 when the follower pin 17 is taken out of the entrance of the cam groove 74 through the opening 45. Thus the follower pin 17 is taken out by sliding the flange 18 on the take-out guide plane 82.

A relief surface 83 is formed by chamfer on the bridging portion 76 of the lever 70, and is disposed in parallel confronting relationship to the take-out plane 82, as shown in FIG. 3. As shown in FIG. 8, the relief surface 83 is formed on the entire circular arc-shaped portion of the outer edge of the leg 71 and prevents the lever 70 from interfering with the guide portion 81 when the lever 70 rotates. As shown in FIG. 3, a tapered surface 84 has the same inclination as the relief surface 83 and is formed on the inner edge of the rear end of the bridging portion 76. Referring to FIG. 16, the follower pin 17 may slide on the tapered surface 84 of the bridging portion 76 at the rear side of the entrance of the cam groove 74.

A triangular guide 47 is formed on the inward edge of each guide plate 38, as shown in FIGS. 7 and 8, and extends in the front-to-back (widthwise) direction of the female housing 21. The guide 47 is formed by connecting the base of the guide plate 38 and the rear end surface of the female-side hood 23 to each other, thus supporting and strengthening the guide plate 38. An inclined plane 48 of the guide 47 is continuous with the outer surface of the guide plate 38 and the outer surface of the wall 41. The front end of the lever 70 is brought into contact with the inclined plane 48 to guide the penetration of the lever 70 into the lever accommodating space 40. The engaging projection 39 is sandwiched between the right and left guides 47, and is a little shorter than the guide 47. Cut-outs 61 are formed at the front end of the cover 50 and at both sides of the positioning convexity 59 for permitting escape of the guide 47.

The operation of the above-described lever-type connector will be described below. First the female connector 20 is assembled from the cover 50 and the lever 70, and then the male and female connectors are fitted on each other.

The female connector 20 is assembled by installing the lever 70 on the cover 50, as shown in FIG. 8, such that the entrance of the cam groove 74 faces the front. Then, as shown in FIG. 6, the seal ring 32 is installed on the terminal accommodation portion 22 of the female housing 21, and the front retainer 30 is installed at the temporary locking position. In this state, the female terminal fittings 25 are inserted into each cavity 24 from the rear of the female housing 21. Then, as shown in FIG. 7, the front retainer 30 is pressed into the main locking position to hold the female terminal fitting 25 in a double locking state. Thereafter, as shown in FIG. 8, the electric wires W taken out from the rear side of the female housing 21 are bundled and bent by about 900 toward the right in FIG. 8. The cover 50 and the lever 70 then are installed on the female housing 21 from the rear. In this installing process, before the cover 50 contacts the female housing 21, the front end of the lever 70 is inserted into the lever accommodation space 40.

Figure 12:
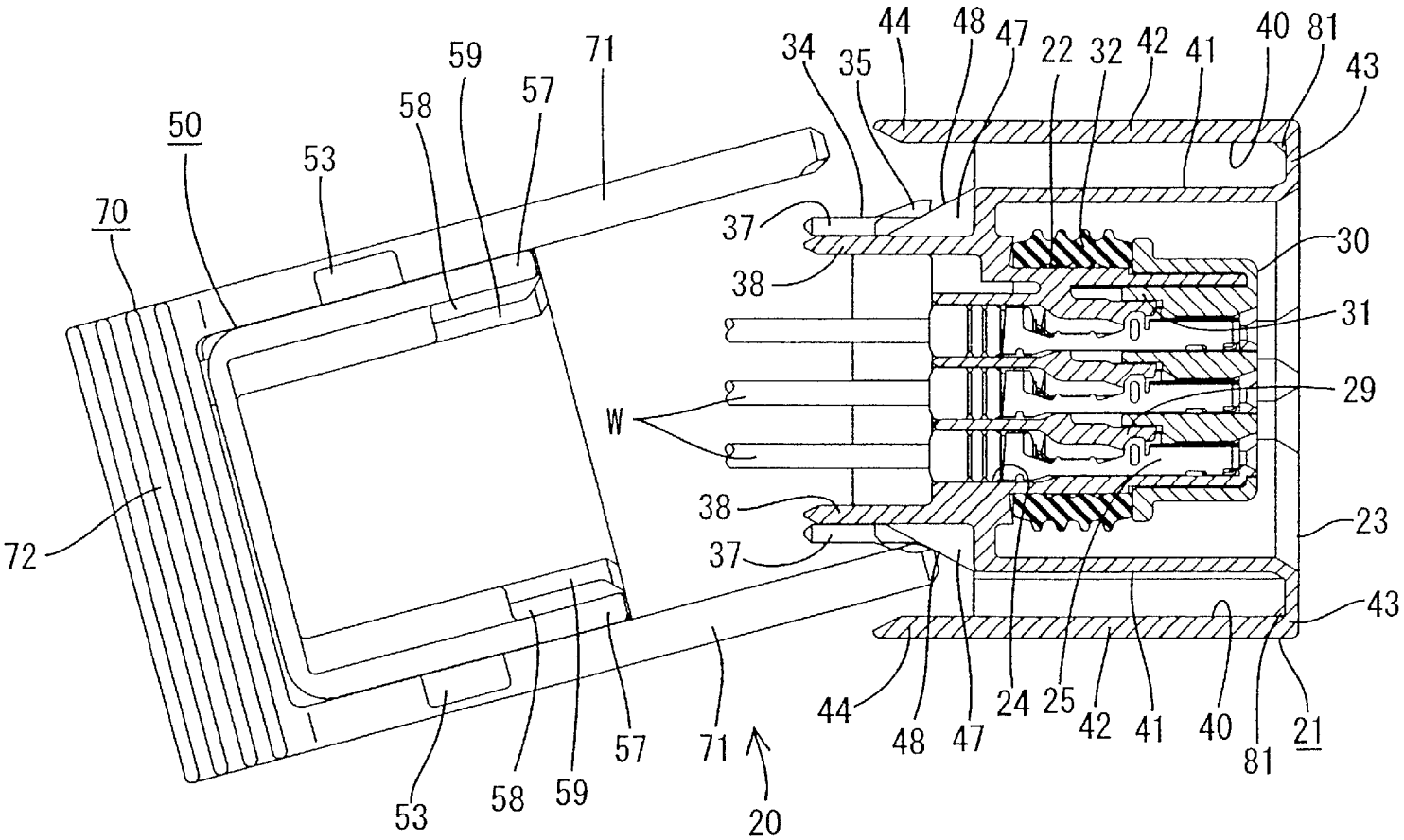
FIG. 12 is partly cutout side view showing a state in which the front end of the lever whose installing posture has inclined is in contact with a guide portion.

When the cover 50 and the lever 70 are installed on the female housing 21 obliquely, as shown in FIG. 12, the front end of the lever 70 contacts the inclined plane 48 of the guide 47. The inclined plane 48 is continuous with the outer surface of the lever accommodation space 40. Thus, the lever 70 is inserted smoothly into the lever accommodation space 40 due to the contact between the front end of the lever 70 and the inclined plane 48.

Figure 13:
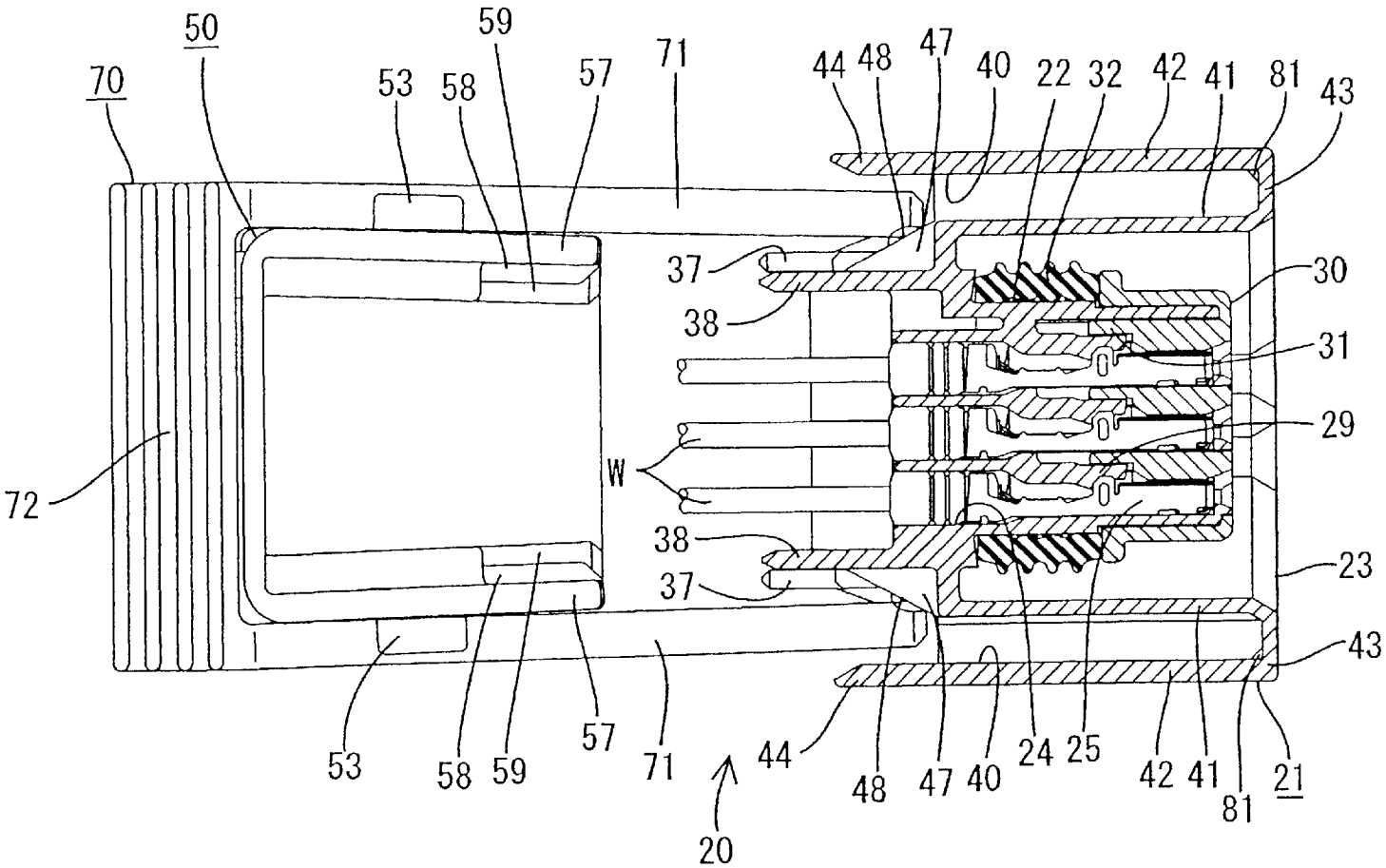
FIG. 13 is partly cutout side view showing a state in which the front end of the lever warped inward is in contact with the guide portion.

As shown in FIG. 13, the front portion of the leg 71 may warp inwardly when the lever 70 is formed by molding. Let it be supposed that the inwardly warped leg 71 is installed on the female housing 21. In this case, even though the cover 50 and the lever 70 are installed on the female housing 21 in a normal posture, the front end of the lever 70 contacts the guide 47. When the lever 70 is moved forward in this state, the front end of the lever 70 slides on the inclined plane 48 and both legs 71 are inserted into the lever accommodation space 40, with both legs 71 open outward. That is, even though the lever 70 is warped, it can be accommodated smoothly in the lever accommodation space 40, with the lever 70 being unwarped and straight.

The front end of the cover 50 reaches the position immediately rearward from the guide plate 38 and the guide projection 37 after the lever 70 is inserted into the lever accommodation space 40. The cover 50 may be dislocated widthwise from the female housing 21 at this time. However, the front end surface of the positioning convexity 59 is brought into contact with the rear end surface of the guide plate 38. Thus, the installing operation is prevented, see FIGS. 9 and 10, and the cover 50 is slid widthwise to correct the dislocation of the cover 50 and to fit the positioning convexity 59 between the guide plates 38. The engaging projection 39 formed between the guide plates 38 is inserted into the engaging groove 60 formed on the positioning convexity 59 when the positioning convexity 59 penetrates between the guide plates 38. At this time, the convexity 58 of the cover 50 slides on the guide plate 38, and the locking piece 57 of the cover 50 slides on the guide projection 37. Thus, the cover-installing operation is facilitated. The locking piece 57 then rides over and is locked to the locking projection 35. Consequently, as shown in FIG. 11, the cover 50 is secured to the female housing 21. At this time, the front end surface of the cover 50 is in contact with the stepped portion of the rear end surface of the female-side hood 23. Additionally, as shown in FIG. 14, the front end of the lever 70 is disposed immediately rearward from the reinforcing wall 43, and the entrance of the cam groove 74 is placed at a position matching the introduction opening 45 of the reinforcing wall 43.

As shown in FIG. 2, the legs 71 are sandwiched between the walls 41 and the accommodation walls 42 without forming a gap therebetween. Thus, if the legs 71 of the lever 70 are warped inward, as shown in FIG. 13, the lever 70 can be accommodated in the lever accommodation space 40, with the leg 71 being kept unwarped or straight.

Figure 15:
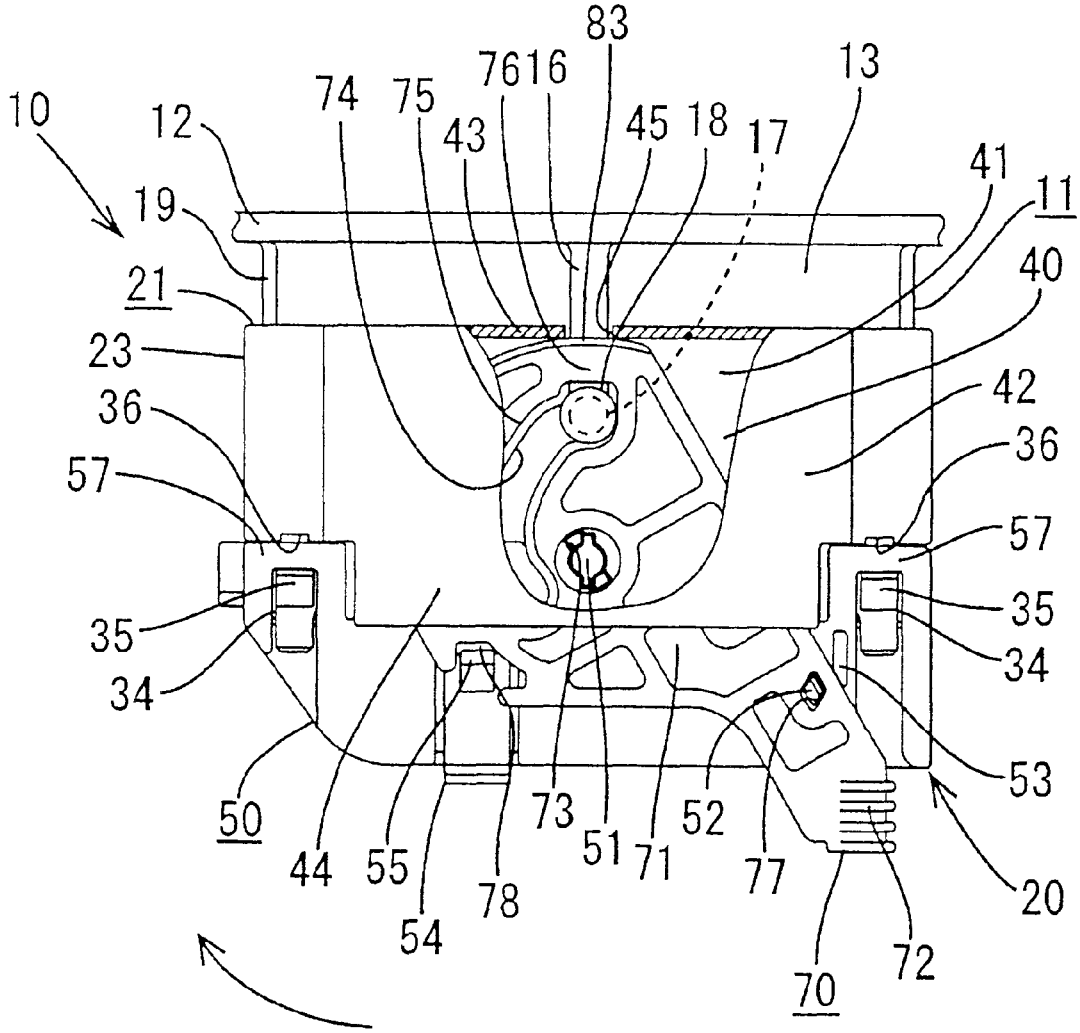
FIG. 15 is partly cutout plan view showing an initial state in fitting both connectors on each other.

After the female connector 20 is assembled from the lever 70 and the cover 50, the female connector 20 is fitted on the male connector 10. The male-side hood 13 of the male connector 10 penetrates between the terminal accommodation portion 22 of the female connector 20 and the female-side hood 23 thereof. Additionally, the follower pin 17 penetrates into the opening 45 of the reinforcing wall 43. At this time, even though the female connector 20 is inclined relative to the male connector 10, the flange 18 of the follower pin 17 slides on the introduction guide surface 80. Thus, the follower pin 17 can penetrate into the opening 45 smoothly. As shown in FIG. 15, after the follower pin 17 passes the open portion 45, the female connector 20 is fitted on the male connector 10 to such an extent that the follower pin 17 penetrates into the rear side of the bridging portion 76 at the entrance of the cam groove 74. At this time, as shown in FIG. 16, the lever 70 is sandwiched between the accommodation wall 42 and the wall 41. Consequently, the entrance of the cam groove 74 and the opening 45 of the reinforcing wall 43 match each other without a vertical dislocation. Accordingly, the operation of penetrating the follower pin 17 into the cam groove 74 from the opening 45 can be performed smoothly.

Figure 17:
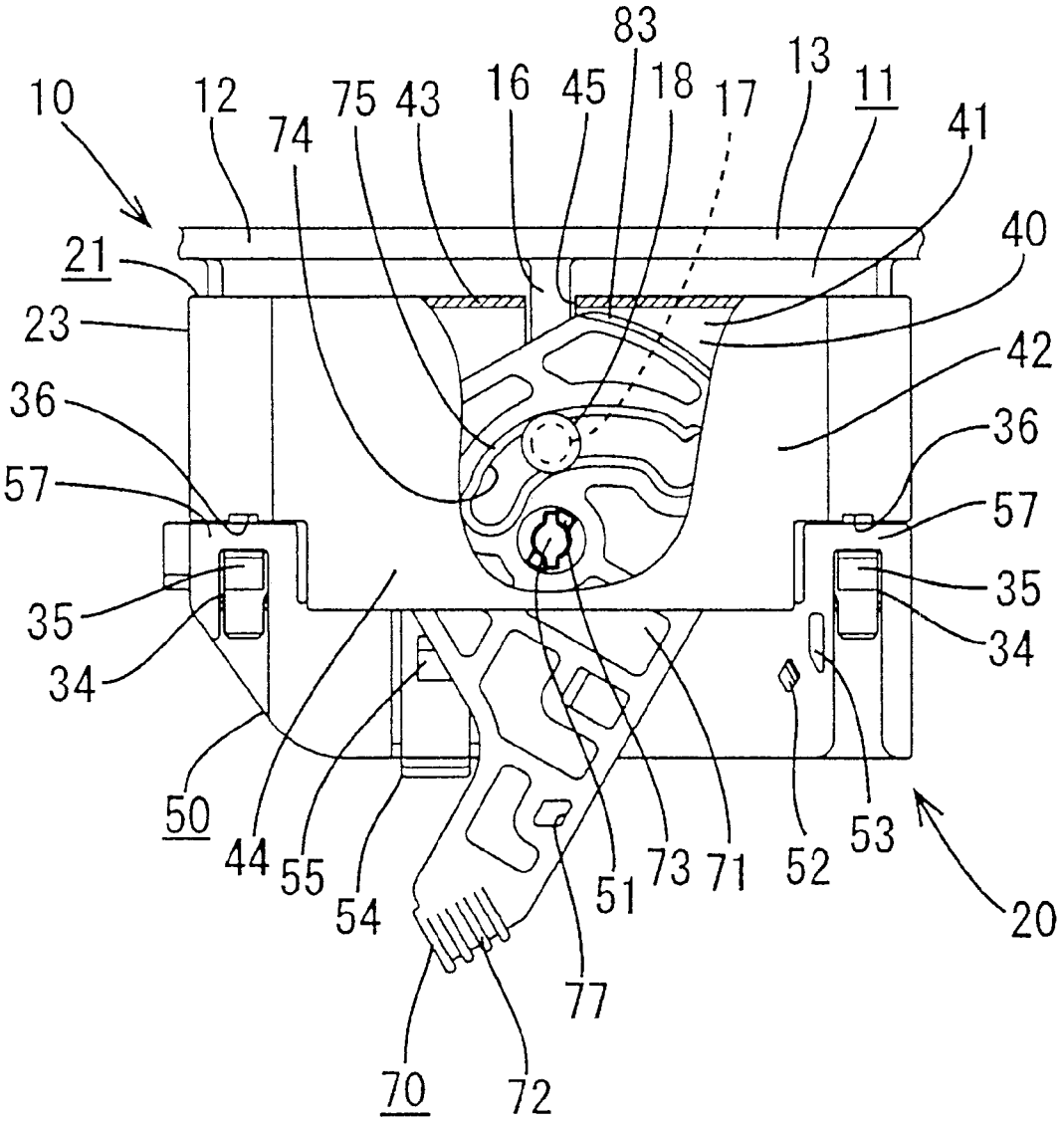
FIG. 17 is partly cutout plan view showing a state in which both connectors are being fitted on each other.

Then, while the first holding projection 52 is being unlocked from the first holding hole 77, the lever 70 is rotated from the initial position in a direction indicated with an arrow of FIG. 15. Rotation of the lever 70, as shown in FIG. 17, causes the follower pin 17 to move inward along the cam groove 74, and thus both connectors 10 and 20 are moved in a direction in which they are fitted on each other to a high extent.

Figure 18:
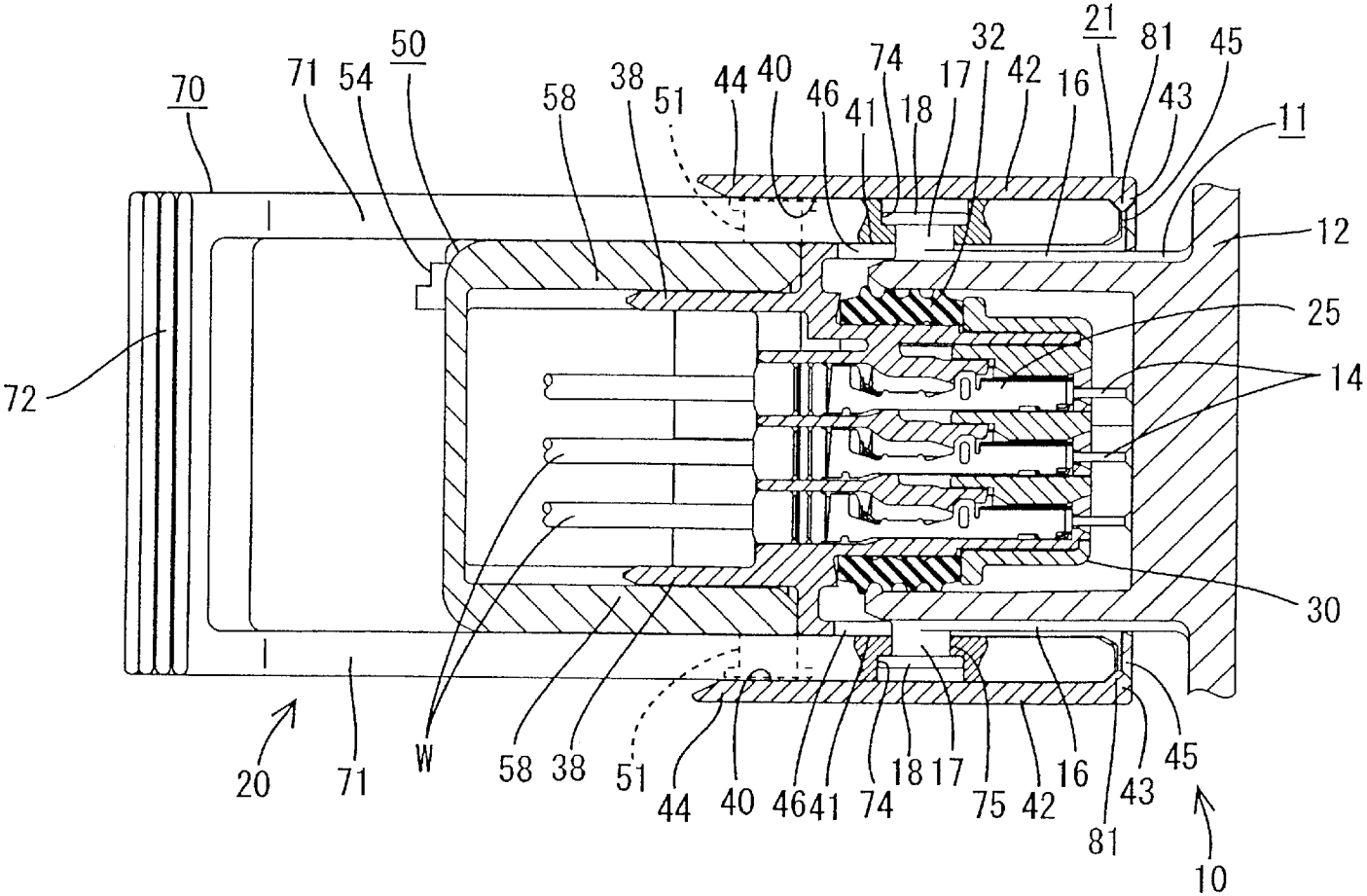
FIG. 18 is partly cutout side view showing a state in which both connectors are being fitted on each other.

A force for opening the legs 71 outward around the shaft construction portion is applied as the lever 70 is rotated. However, as shown in FIG. 18, the legs 71 are sandwiched between the accommodation walls 42 and the walls 41 without forming a gap. Further, the force acting on the legs 71 can be received by the accommodation walls 42 and the extended walls 44 disposed outside the shaft construction portion. Thus, it is possible to prevent the lever 70 from being deformed outward, and it is possible to prevent the lever 70 from slipping off the cover 50. Further, because the reinforcing wall 43 extends continuously between the front end of the accommodation wall 42 and the wall 41. Therefore, the accommodation wall 42 is strong enough to receive the force applied thereto by the lever 70.

The force acting on the lever 70 in the direction in which the legs 71 are opened outward also acts on the cover 50 installed on the lever 70. The direction of the force acting on the cover 50 is the same as the direction in which the locking piece 57 and the locking projection 35 are unlocked from each other. Thus, if the cover 50 is opened and deformed by the applied force, there is a possibility that the cover 50 could slip off the female housing 21. As shown in FIGS. 9 and 10, the side surface of the engaging projection 39 of the female housing 21 engages the periphery of the engaging groove 60 of the cover 50. Thus, the force acting on the cover 50 in the direction in which it is opened outward can be received between the cover 50 and the female housing 21. Accordingly, it is possible to prevent the cover 50 from being opened, and thus it is possible to prevent the cover 50 from slipping off the female housing 21. Further, the engaging groove 60 and the engaging projection 39 are disposed directly inward from the rotational shaft of the lever 70 on which the force is applied at a highest degree during its rotation, thus receiving the force. Accordingly, it is possible to effectively prevent the cover 50 from being opened.

Figure 20:
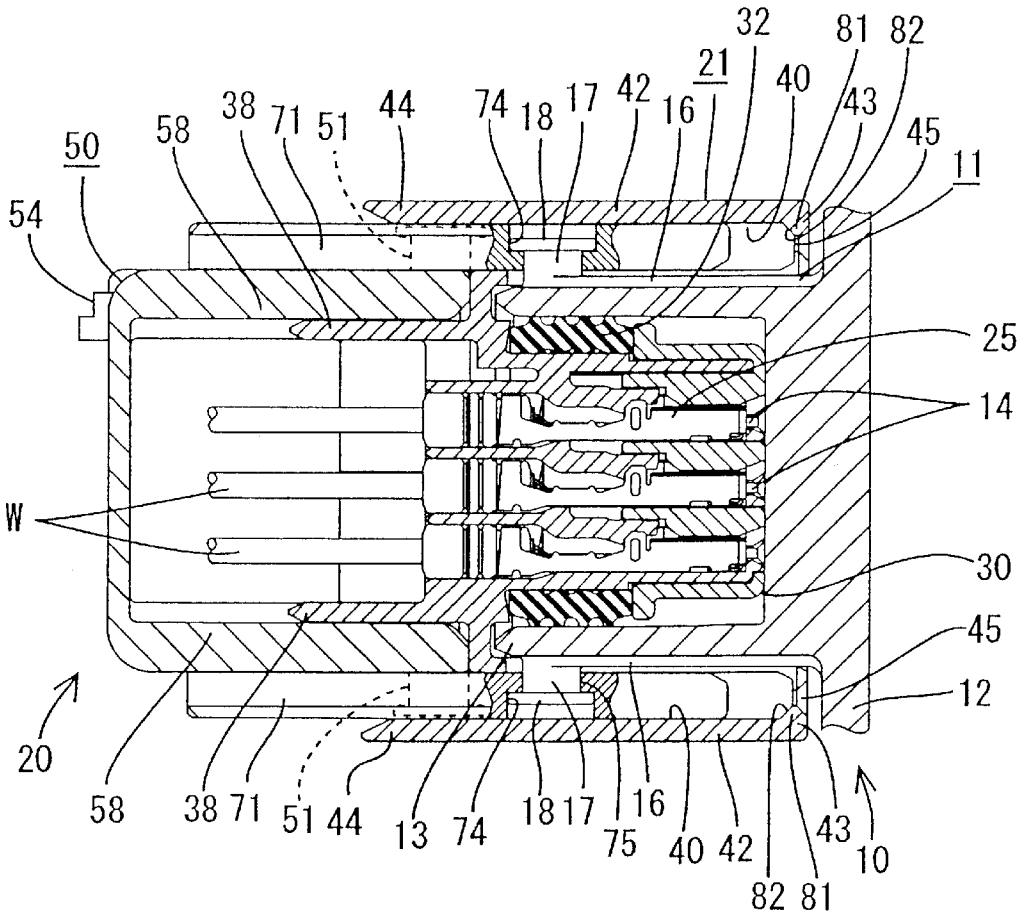
FIG. 20 is partly cutout side view showing a state in which both connectors have been normally fitted on each other.

When the lever 70 is rotated to the completion position, as shown in FIG. 19, the follower pin 17 reaches the termination of the cam groove 74, and both connectors 10 and 20 are fitted on each other in a normal extent. At this time, the second holding hole 79 of the lever 70 is locked to the second holding portion 55 of the cover 50. Thus, the lever 70 is held unrotatably in the completion position. Therefore, both connectors 10 and 20 are held unseparably from the normal fit-on state. At this time, as shown in FIG. 20, the male and female terminal fittings 14 and 25 are electrically conductively connected to each other, and the hood 13 of the male housing 11 contacts the peripheral surface of the seal ring 32 closely, thus waterproofing the gap between both connectors 10 and 20.

When both connectors 10 and 20 are separated from each other for maintenance or the like, the lever 70 is rotated from the completion position in the direction opposite the direction in which the lever 70 is rotated during the connector fit-on operation. Rotation of the lever 70 causes the follower pin 17 to move to the entrance of the cam groove 74, and thus both connectors 10 and 20 are moved in the separation direction. As shown in FIGS. 15 and 16, when the lever 70 is rotated to the initial position, the follower pin 17 reaches the entrance of the cam groove 74, and the entrance of the cam groove 74 substantially matches the peripheral surface of the open portion 45 of the reinforcing wall 43. Both connectors 10 and 20 are separated from each other in this state.

Figure 21:
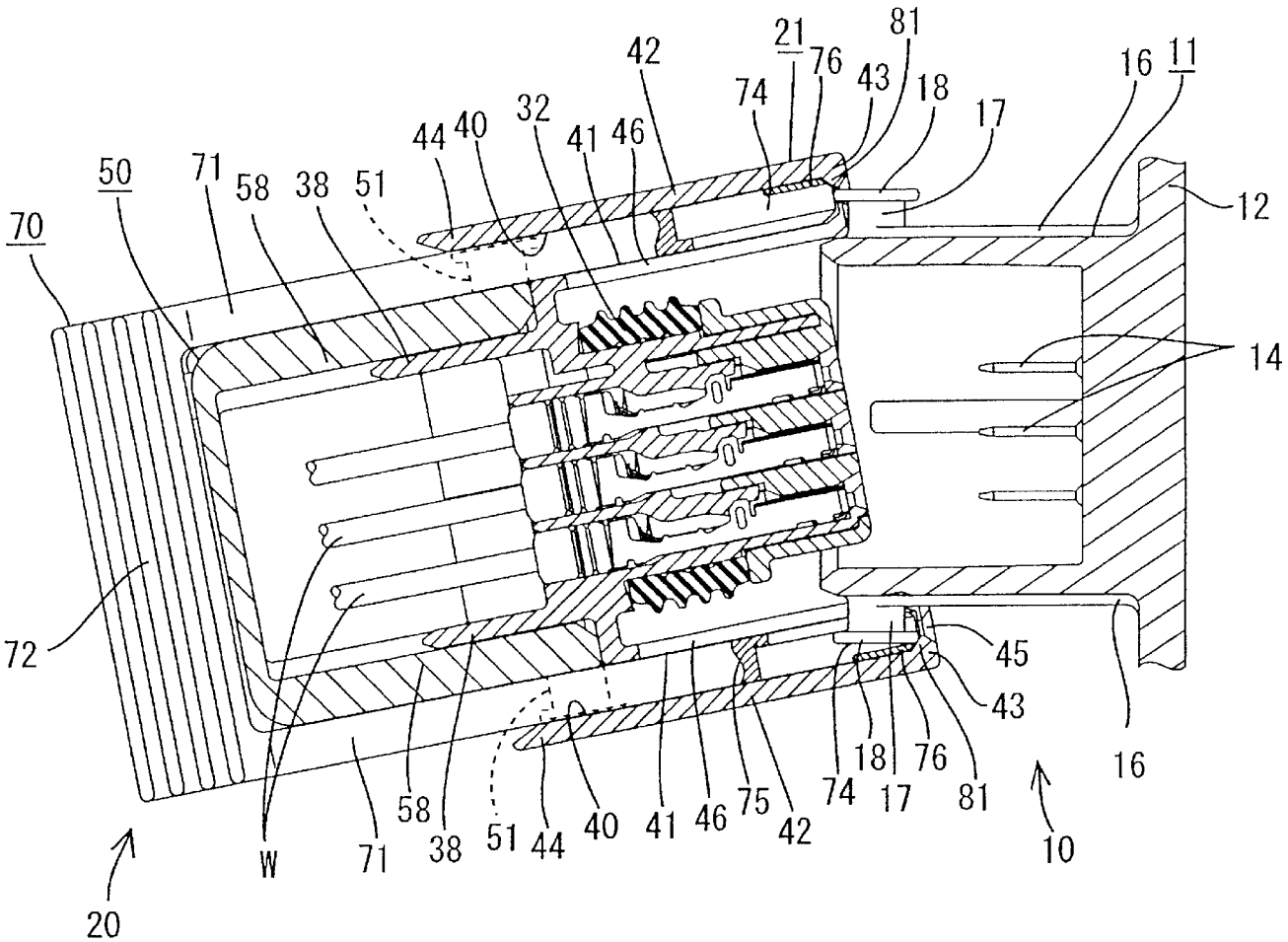
FIG. 21 is partly cutout side view showing a state in which the female connector to be removed inclines because an entrance of a cam groove has a play.
Figure 22:
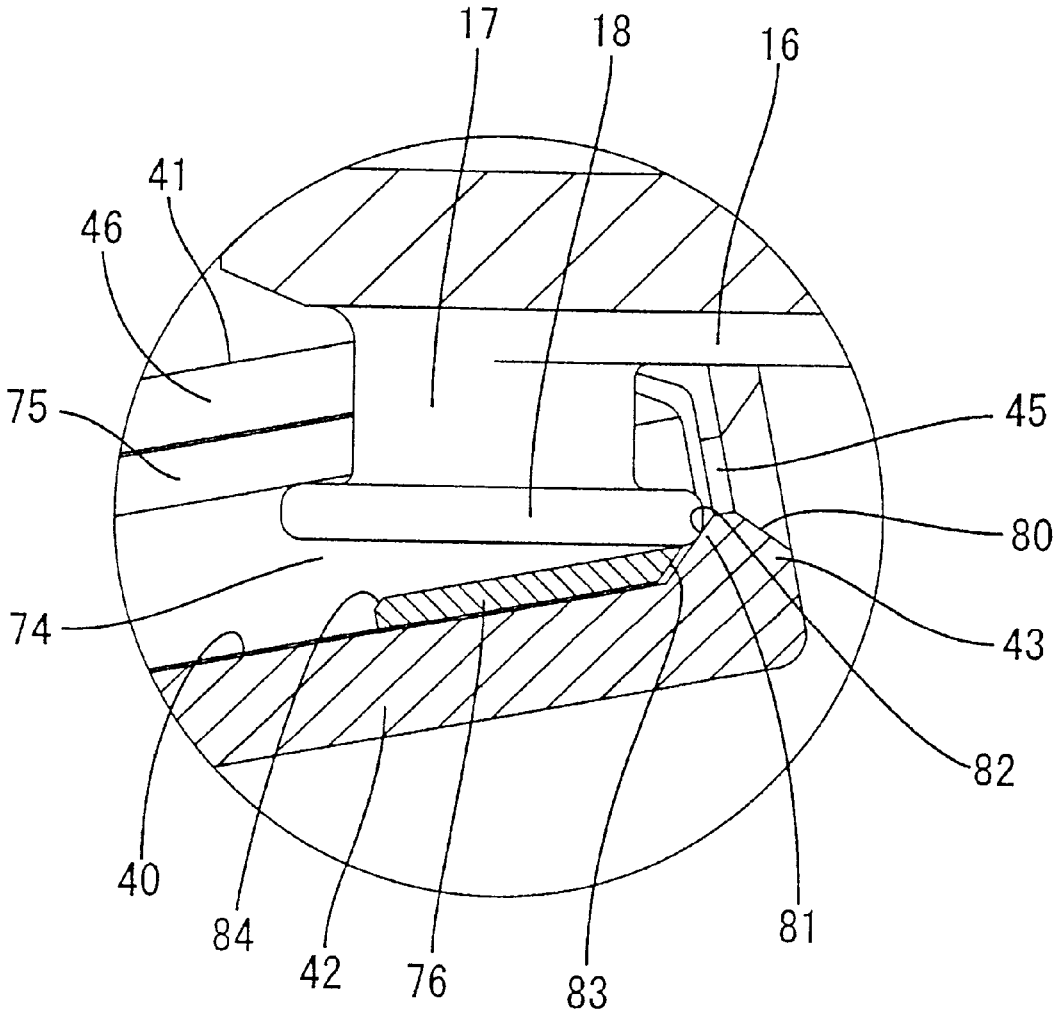
FIG. 22 is an enlarged view showing the neighborhood of a guide portion in FIG. 21.

In a molding operation, there is a variation in the thickness of the lever 70 within a tolerance. For example, when the thickness of the bridging portion 76 of the entrance of the cam groove 74 and that of the receiving portion 75 are formed thinner than a predetermined thickness, the play of the cam groove 74 relative to the follower pin 17 is great. In this case, the connectors 10 and 20 will be loose during the separation operation. Thus, as shown in FIG. 21, there is a case in which the female connector 20 is separated from the male connector 10 by inclining the female connector 20. Referring to FIG. 16, in this case, when the follower pin 17 at the rear side of the entrance of the cam groove 74 moves relative to the forwardly disposed bridging portion 76, the follower pin 17 slides on the tapered surface 84 on the rear end of the bridging portion 76. In this manner, the movement of the follower pin 17 is guided. When the follower pin 17 moves further forward from the bridging portion 76, as shown in FIG. 22, the flange 18 of the follower pin 17 contacts the take-out guide surface 82 of the guide 81. As the female connector 20 moves rearward further from this state, the flange 18 slides on the take-out guide surface 82. Thus, the follower pin 17 can be moved smoothly to the peripheral surface of the open portion 45. In this manner, the operation of removing both connectors 10 and 20 from each other can be accomplished smoothly.

The cover 50 can be removed from the female connector 20, as shown in FIG. 11, by inserting a release jig into the jig insertion groove 36. A removal operation then is performed, with the jig applied to the rear end surface of the female-side hood 23. As a result, the lever action of the jig enables the locking piece 57 to be flexed and unlocked from the locking projection 35.

As described above, when the follower pin 17 is moved from the entrance of the cam groove 74 to the open portion 45, the follower pin 17 is capable of sliding on the take-out guide surface 82 of the guide 81 formed on the outer side of the edge of the open portion 45. Thus, the operation of removing both connectors 10 and 10 from each other can be smoothly accomplished.

The technical scope of the present invention is not limited to the above-described embodiment, but the following embodiments are included in the technical scope of the present invention. In addition to the following embodiments, the present invention can be embodied by varying it in various modes without departing from the gist of the present invention.

In the above-described embodiment, the guide is formed on only the outer side of the edge of the opening. However, it is possible to from the guide on the inner side of the edge confronting the outer side thereof. It is also possible to form the guide on the right and left sides, of the edge of the opening, through which the flange of the follower pin passes. In this case, when the female connector is separated from the male connector, with the female connector inclining widthwise, the follower pin can be guided to the opening. It is also possible to form the guide over the entire periphery of the edge of the opening. In this case, it is possible to perform the operation of taking out the follower pin smoothly irrespective of inclination direction of the female connector.

In the above-described embodiment, the guide is formed in the center (within the size of the open portion) of the reinforcing wall. However, it is possible to form the guide on the reinforcing wall over the entire width thereof depending on the construction of a female housing-shaping die.

What is claimed is:

1. A lever-type connector, comprising:

a first connector housing having a first hood with a front end, oppositely directed top and bottom follower pins formed on the first hood, a second connector housing having a second hood with a front end, the front end of the first hood being insertable into the front end of the second hood, the second hood comprising opposed top and bottom hood walls formed respective with top and bottom guide grooves extending rearwardly from the front end and disposed to receive the follower pins when the first hood is inserted into the second hood, top and bottom accommodation walls parallel to and spaced from the respective top and bottom hood walls for defining top and bottom lever accommodation spaces, a lever having parallel top and bottom legs rotatably mounted in the respective top and bottom lever accommodation spaces on the second connector housing, the legs each having a cam groove dimensioned to receive a respective one of the follower pins such that rotation of the lever moves the follower pins in the guide grooves and moves the first and second connector housings relative to one another, and top and bottom reinforcing walls extending between the respective top and bottom accommodation walls and the top and bottom hood walls at the front end of the second hood, the reinforcing walls each having an opening aligned with one of the guide grooves and dimensioned to receive one of said follower pins, a rearwardly facing surface of each said reinforcing wall adjacent the respective opening being tapered to facilitate alignment of the follower pin with the opening during separation of the housings.

2. The lever-type connector of claim 1, wherein the second connector housing further comprises a rear end, a cover being mounted to the rear end, the lever being mounted to the cover.

3. The lever-type connector of claim 1, wherein portions each said leg of the lever adjacent the respective cam groove define a bridging wall with a tapered rear surface for guiding the follower pins toward the respective openings.

4. The lever-type connector of claim 3, wherein the tapered rear surface of each of the bridging wall is substantially parallel to the tapered rearwardly facing surface adjacent the respective opening of the reinforcing wall.

5. The lever-type connector of claim 4, wherein each of the bridging wall further comprises a tapered front surface aligned substantially parallel to the tapered rear surface thereof.

6. The lever-type connector of claim 5, wherein the top and bottom legs of the lever are substantially parallel to and in sliding engagement with the top and bottom hood walls of the second hood.

7. The lever-type connector of claim 6, wherein the bridging walls are substantially parallel to and spaced from the respective top and bottom hood walls of the second hood.

8. The lever-type connector of claim 1, wherein front-facing surfaces of the reinforcing walls adjacent the openings are tapered to facilitate insertion of the follower pin.

9. The lever-type connector of claim 1, wherein the top and bottom follower pins are substantially adjacent the front end of the first hood.

10. The lever-type connector of claim 9, wherein each said follower pin include a cylindrical base portion adjacent the first hood and a disc-shaped flange spaced from said first hood, the flange having rounded edges for guiding engagement with the tapered rearwardly facing surfaces of the openings in the reinforcing wall.

11. The lever-type connector of claim 1, wherein the openings are spaced from the top and bottom accommodation walls, the tapered rearwardly facing surfaces of the reinforcing walls adjacent the respective openings including surfaces extending toward the respective top and bottom hood walls.

12. The lever-type connector of claim 11, wherein the cam grooves of the lever each include an opening end alignable with the opening in the reinforcing wall when the lever is in an initial rotational orientation relative to the second connector housing, bridging walls formed on portions of said lever adjacent the respective top and bottom accommodation walls and bridging the opening end of the respective cam grooves, the bridging walls each defining a thickness substantially equal to a distance between the respective openings and the corresponding top and bottom accommodation walls.

* * * * *